US006358677B1

(12) United States Patent
Taniguchi et al.

(10) Patent No.: US 6,358,677 B1
(45) Date of Patent: Mar. 19, 2002

(54) HEAT-DEVELOPABLE RECORDING MATERIAL

(75) Inventors: Masahiko Taniguchi; Katsuyuki Watanabe; Shigeo Hirano; Minoru Sakai, all of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/528,450

(22) Filed: Mar. 17, 2000

(30) Foreign Application Priority Data

Mar. 18, 1999 (JP) ..... 11-073950
Nov. 30, 1999 (JP) ..... 11-340760

(51) Int. Cl.[7] ..... G03C 1/498

(52) U.S. Cl. ..... 430/619; 430/264; 430/613; 430/617

(58) Field of Search ..... 430/619, 264, 430/598, 613, 617

(56) References Cited

U.S. PATENT DOCUMENTS 5,545,515 A * 8/1996 Murray et al. ..... 430/617
5,705,324 A * 1/1998 Murray ..... 430/350
6,040,130 A * 3/2000 Alton et al. ..... 430/619

FOREIGN PATENT DOCUMENTS

EP 0921433 6/1999
JP 10221806 8/1998

* cited by examiner

*Primary Examiner*—Thorl Chea
(74) *Attorney, Agent, or Firm*—Birch, Stewart, Kolasch & Birch, LLP

(57) ABSTRACT

A heat-developable recording material having, at least on one side and the same side of the support, (a) reducible silver salt, (b) a reducing agent other than a compound represented by the general formula (1) below, (c) a binder, and (d) at least one compound represented by the general formula (1) below; content of the compound represented by the general formula (1) being 0.01 to 100 mol % with respect to the reducing agent:

general formula (1)

[where in the general formula (1), $R^1$, $R^2$, $R^3$, $X^1$ and $X^2$ independently represent a hydrogen atom; halogen atom; or substituent which is bound to the benzene ring via a carbon atom, oxygen atom, nitrogen atom, sulfur atom or phosphorus atom. At least either $X^1$ or $X^2$ represents a group represented as —$NR^4R^5$, where $R^4$ and $R^5$ independently represent a group selected from a hydrogen atom, alkyl group and the like.]

7 Claims, 1 Drawing Sheet

HEAT-DEVELOPABLE RECORDING MATERIAL

FIELD OF THE INVENTION

The present invention relates to a heat-developable recording material, and more particularly to a heat-developable recording material with an excellent stability against fluctuations in heat development conditions.

BACKGROUND OF THE INVENTION

Methods for forming an image by heat development are described, for example, in U.S. Pat. Nos. 3,152,904 and 3,457,075 and D. Morgan and B. Shely, Imaging Processes and Materials, "Thermally Processed Silver Systems" A, 8th ed., page 2, compiled by Sturge, V. Walworth and A. Shepp, Neblette (1969). The photosensitive material used contains a reducible non-photosensitive silver source (e.g., organic silver salt), a catalytic amount of photocatalyst (e.g., silver halide), and a reducing agent for silver, which are usually dispersed in an organic binder matrix. This photosensitive material is stable at room temperature. While these photosensitive materials are stable at room temperature, they produce blackened silver when heated, after light exposure, to a high temperature (e.g. 80° C. or higher) through redox reaction between the reducible silver source (which functions as an oxidizing agent) and the reducing agent. This reaction is promoted by a catalytic action of latent image generated by the exposure. The silver produced by the reaction of the reducible silver salt in the exposed region provides a black image and this presents a contrast to the non-exposed region. Thus, an image is formed.

Thus obtained black image is used in recording materials for microfilm medical use such as Roentogen imaging, and printing plate making. These conventional recording materials are based on a photographic principle, and development thereof generally rely upon methods using process chemical solution. There is, however, an urgent need for addressing environmental issues, so that a heat development system without using such process chemical in a solution form and thus free from environmental impact is desired.

There is also a strong need for reducing waste process solution in the field of photoengraving from the viewpoints of environmental preservation and space saving. Thus desired is a technology related to photosensitive heat-developable material for photoengraving allowing efficient light exposure with a laser scanner or laser image setter, and capable of providing a clear black image with a high resolution and sharpness.

The heat-developable recording material, however, suffers from difficulties in precisely defining the development process conditions as compared with the conventional development method using a processing solution. For example, the photosensitive material is heated for development after light exposure, where non-uniformity in the temperature distribution may result in a large difference in image quality. In particular for photosensitive material for printing plate making, a gradation hardener is used for amplifying information in the exposed area to obtain an ultrahigh contrast image, where a minute retardation of the development process may be output with quite a large difference in the density of the black image produced by silver. To suppress such difference in the image quality depending on the developing conditions, it is thus desired to provide a technology for efficiently accelerating the development only at the exposed region. When viewed from another aspect, such acceleration effect of the development will also shorten the developing time, and may be advantageous in rapid image creation.

Approaches for creating an ultrahigh contrast image appropriate to printing plate making based on so-called dry silver process are known in the literatures below. U.S. Pat. Nos. 5,464,738 and 5,512,411 disclose the use of sulfonyl hydrazine compounds as a reducing agent. U.S. Pat. Nos. 5,496,695 and 5,536,622 disclose the use of hindered phenol compounds as a reducing agent, along with the use of a certain kind of hydrazine compounds as an ultrahigh contrast agent. U.S. Pat. No. 5,545,515 discloses the use of hindered phenol compounds as a reducing agent and acrylonitrile compounds as an ultrahigh contrast agent. Problems to be overcome, however, still remain even with these compounds since higher temperature or longer time period is necessary for the development.

A reducing agent for the dry silver has already been known, which can be found in, for example, JP-A-7-13295 (the code "JP-A-" as used in this specification means an "unexamined published Japanese patent application"), JP-A-7-5621, U.S. Pat. Nos. 3,667,958 and 5,350,669. In these patents reported are examples of combined uses of, for example, polyhydroxybenzenes and hydroxylamines. It is, however, still difficult with these techniques to satisfy the performance desired at present.

It has been reported to use, as a reducing agent, phenol compounds having as a substituent an amino group substituted by an electron withdrawing group (e.g. sulfonamidophenol). For example, independent uses of sulfonamidophenol compounds, such as 2,6-dichloro-4-benzenesulfonamidophenol and p-benzenesulfonamidophenol, as a reducing agent are known by JP-A-49-80386, JP-A-5-257227 and JP-A-10-221806. These methods are, however, disadvantageously slow in development speed so that degradation of the image quality due to such delay in the development is inevitable. These methods are also unfavorable in terms of increasing trends in fogging.

Several accelerating techniques have already been known, which are disclosed in, for example, U.S. Pat. No. 5,637,449, No. 5,545,505, No. 5,545,507 and No. 5,496,695. A satisfactory level of acceleration effect for the development has, however, not been reached, and the problem in the degradation of image quality due to delayed development still remains unchanged.

SUMMARY OF THE INVENTION

It is therefore an object of the present invention to solve the conventional technology described above. That is, a problem to be solved by the present invention relates to provision of a heat-developable recording material with a small sensitivity changes against fluctuations in heat development conditions, thereby to allow stable heat development.

The present inventors found out, after extensive studies, that stable image formation was achieved even under fluctuated heat development conditions by using a compound having a specific structure, which has led us to the present invention.

That is, the present invention provides a heat-developable recording material having, at least on one side and the same side of the support, (a) reducible silver salt, (b) a reducing agent other than a compound represented by the general formula (1) below, (c) a binder, and (d) at least one compound represented by the general formula (1) below; content of the compound represented by the general formula (1) being 0.01 to 100 mol % with respect to the reducing agent:

general formula (1)

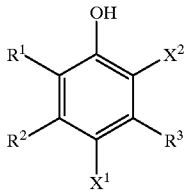

[where in the general formula (1), $R^1$, $R^2$, $R^3$, $X^1$ and $X^2$ independently represent a hydrogen atom; halogen atom; or substituent which is bound to the benzene ring via a carbon atom, oxygen atom, nitrogen atom, sulfur atom or phosphorus atom. At least either $X^1$ or $X^2$ represents a group represented as —$NR^4R^5$, where $R^4$ and $R^5$ independently represent a group selected from a hydrogen atom, alkyl group, alkenyl group, alkynyl group, aryl group, or a group represented by —C-(═O)-R, —C-(═O)-C(═O)-R, —$SO_2$-R or —SO—R. R represents a group selected from a hydrogen atom, alkyl group, aryl group, heterocyclic group, amino group, alkoxy group and aryloxy group. Adjacent groups of the above substituents may bind each other to form a ring.]

In a preferred embodiment of the present invention, the heat-developable recording material is a heat-developable photosensitive recording material containing a photosensitive silver halide, and preferably using hindered phenol compounds as a reducing agent.

It is also preferable to use an ultrahigh contrast agent in the present invention. Preferable ultrahigh contrast agent can be at least one compound selected from the group consisting of the compounds respectively represented by the general formulae (2), (3) and (4), below:

general formula (2)

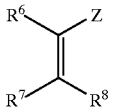

general formula (3)

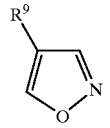

general formula (4)

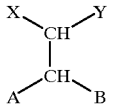

[where in the general formula (2), $R^6$, $R^7$ and $R^8$ independently represent a hydrogen atom or substituent, and Z represents an electron withdrawing group or silyl group. In the general formula (2), $R^6$ and Z; $R^7$ and $R^8$; $R^6$ and $R^7$; or $R^8$ and Z may bind with each other to form a ring structure. In the general formula (3), $R^9$ represents a substituent. In the general formula (4), X and Y independently represent a hydrogen atom or substituent; and A and B independently represent an alkoxy group, alkylthio group, alkylamino group, aryloxy group, arylthio group, anilino group, heterocyclic oxy group, heterocyclic thio group or heterocyclic amino group. In the general formula (4), X and Y; or A and B may bind with each other to form a ring structure.]

According to the present invention, a heat-developable ultrahigh contrast photosensitive material suitable for printing plate making is obtained in which a high sensitivity and small difference of sensitivity under fluctuated conditions in heat development are attained while keeping a sufficiently small Dmin, and in which, in particular for the case of combined use with an ultrahigh contrast agent, an ultrahigh contrast, high Dmax, small difference of sensitivity under fluctuated conditions in heat development and high process stability are attained while keeping a sufficiently small Dmin.

DETAILED DESCRIPTION OF THE INVENTION

Figure 1:
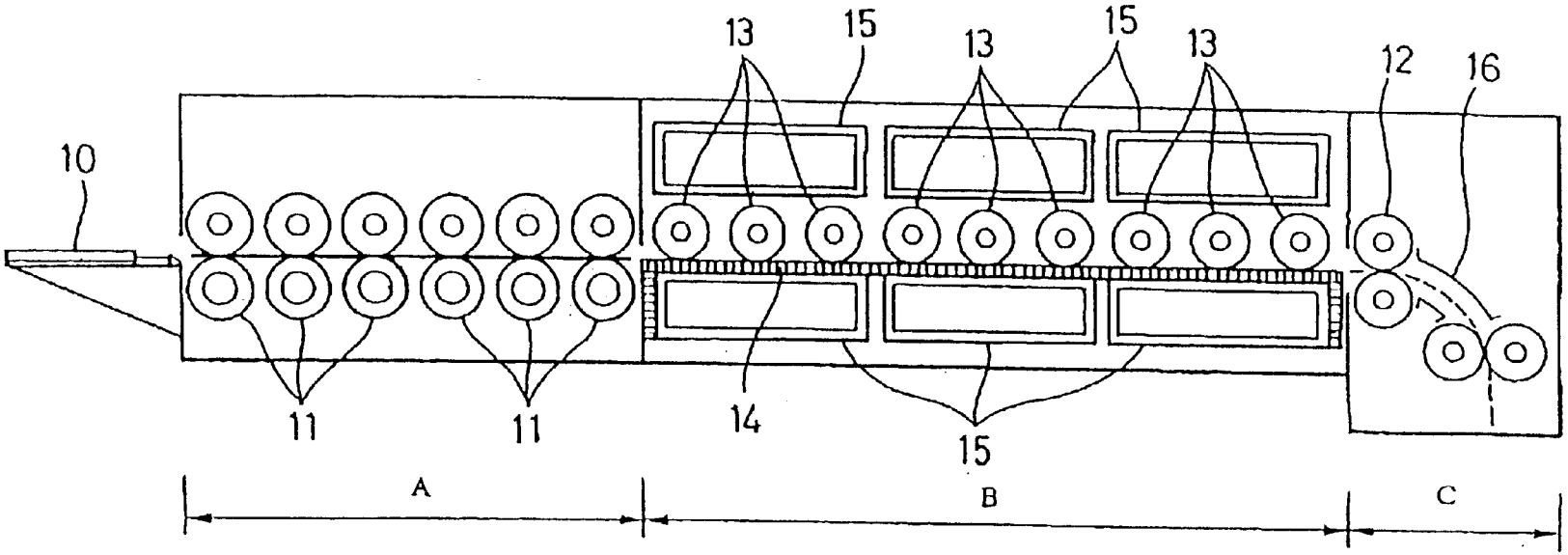
FIG. 1 is a side view showing a structural example of a heat-developing apparatus used for heat development of the heat-developable recording material of the present invention. A denotes preheating section, B denotes heat developing section and C denotes slow cooling section.

The present invention will be detailed hereinafter.

The heat-developable recording material of the present invention contains, as a developing aid, a phenol compound as represented by the general formula (1) having, as a substituent, an amino group substituted by an electron withdrawing group such as acylamino group and sulfonylamino group. Development is promoted by action of such compound, thereby to obtain an image stable against fluctuations in the heat development conditions without increasing thermal fogging at the non-image portion. Thus the heat-developable recording material of the present invention is stable against fluctuations in the heat development conditions (i.e. small fluctuation in sensitivity) and suitable for printing plate making.

First, the compound represented by the general formula (1) is explained in detail.

The compound represented by the general formula (1) is shown below:

general formula (1)

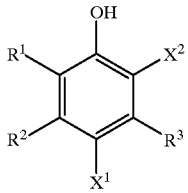

$R^1$, $R^2$, $R^3$, $X^1$ and $X^2$ independently a hydrogen atom; halogen atom, or substituent which is bound to the benzene ring via a carbon atom, oxygen atom, nitrogen atom, sulfur atom or phosphorus atom.

Examples of the substituents bound to the benzene ring via a carbon atom include normal, branched or cyclic alkyl group (e.g. methyl, ethyl, isopropyl, tert-butyl, n-octyl, tert-amyl, 1,3-tetramethylbutyl and cyclohexyl); alkenyl group (e.g. vinyl, allyl, 2-butenyl and 3-pentenyl); alkynyl group (e.g. propargyl and 3-pentinyl); aryl group (e.g. phenyl, p-methylphenyl and naphthyl); acyl group (e.g. acetyl, benzoyl, formyl and pivaloyl); alkoxycarbonyl group (e.g. methoxycarbonyl and ethoxycarbonyl); aryloxycarbonyl group (e.g. phenoxycarbonyl); carbamoyl group (e.g. carbamoyl, diethylcarbamoyl and phenylcarbamoyl); cyano group, carboxyl group; and heterocyclic group (e.g. 3-pyrazolyl).

Examples of the substituents bound to the benzene ring via an oxygen atom include hydroxyl group; alkoxy group (e.g. methoxy, ethoxy and butoxy); aryloxy group (e.g. phenyloxy and 2-naphthyloxy); heterocyclic oxy group (e.g. 4-pyridyloxy); and acyloxy group (e.g. acetoxy and benzoyloxy).

Examples of the substituent bound to the benzene ring via a nitrogen atom include amino group (e.g. amino, methylamino, dimethylamino, diethylamino and dibenzylamino); nitro group; hydrazino group; heterocyclic (e.g. 1-imidazolyl and morpholyl); acylamino group (e.g. acetylamino and benzoylamino); alkoxycarbonylamino group (e.g. methoxycarbonylamino); aryloxycarbonylamino group (e.g. phenyloxycarbonylamino); sulfonylamino group (e.g. methanesulfonylamino and benzene sulfonylamino); sulfamoylamino group (e.g. sulfamoylamino, methylsulfamoylamino, dimethylsulfamoylamino and phenylsulfamoylamino); ureide group (e.g. ureide, methylureide and phenylureide); phosphorylamino group (e.g. diethylphosphorylamino); imido group (e.g. succinimido, phthalimido and trifluoromethane sulfonimido).

Examples of the substituent bound to the benzene ring via a sulfur atom include mercapto group; disulfide group, sulfo group; sulfino group; sulfonylthio group; thiosulfonyl group; alkylthio group (e.g. methylthio and ethylthio); arylthio group (e.g. phenylthio); sulfonyl group (e.g. mesyl, tosyl and phenylsulfonyl); sulfinyl (e.g. methanesulfinyl and benzenesulfinyl); and heterocyclic thio group (e.g. 2-imidazolylthio).

Examples of the substituent bound to the benzene ring via a phosphorus atom include phosphinyl group (e.g. diethoxylphosphinyl and diphenylphosphinyl).

$R^1$, $R^2$ or $R^3$ preferably a hydrogen atom, halogen atom, normal, branched or cyclic alkyl group, aryl group, acyl group, alkoxycarbonyl group, aryloxycarbonyl group, cyano group, carboxyl group, heterocyclic group, hydroxyl group, alkoxy group, aryloxy group, heterocyclic oxy group, acyloxy group, amino group, nitro group, acylamino group, alkoxycarbonylamino group, aryloxycarbonylamino group, sulfonylamino group, imido group, sulfamoyl group, carbamoyl group, ureide group, mercapto group, disulfide group, sulfo group, sulfino group, alkylthio group, arylthio group, sulfonyl group, sulfinyl group or heterocyclic thio group.

$R^1$, $R^2$ or $R^3$ is more preferably a hydrogen atom, halogen atom, normal, branched or cyclic alkyl group, aryl group, acyl group, alkoxycarbonyl group, aryloxycarbonyl group, cyano group, carboxyl group, heterocyclic group, hydroxyl group, alkoxy group, aryloxy group, acyloxy group, amino group, nitro group, heterocyclic oxy group, acylamino group, alkoxycarbonylamino group, aryloxycarbonylamino group, sulfonylamino group, imido group, carbamoyl group, mercapto group, sulfo group, alkylthio group, arylthio group or sulfonyl group.

$R^1$, $R^2$ or $R^3$ is still more preferably a hydrogen atom, halogen atom, methyl group, t-butyl group, cyclohexyl group, phenyl group, 3,5-dichlorophenyl, acetyl group, benzoyl group, ethoxycarbonyl group, phenoxycarbonyl group, cyano group, carboxyl group, acetoxy group, acetylamino group, methoxycarbonylamino group, phenoxycarbonylamino group, methansulfonylamino group, carbamoyl group, sulfo group, trifluoromethylsulfonyl group or benzenesulfonyl group.

Preferable groups for $X^1$ and $X^2$ other than those represented by —$NR^4R^6$ include a hydrogen atom, halogen atom, normal, branched or cyclic alkyl group, aryl group, acyl group, alkoxycarbonyl group, aryloxycarbonyl group, cyano group, carboxyl group, heterocyclic group, hydroxyl group, alkoxy group, aryloxy group, heterocyclic oxy group, acyloxy group, nitro group, sulfamoyl group, carbamoyl group, ureido group, mercapto group, disulfide group, sulfo group, alkylthio group, arylthio group, sulfonyl group or heterocyclic thio group.

More preferable groups for $X^1$ and $X^2$ other than those represented by —$NR^4R^5$ include a hydrogen atom, halogen atom, normal, branched or cyclic alkyl group, aryl group, acyl group, alkoxycarbonyl group, aryloxycarbonyl group, cyano group, carboxyl group, hydroxyl group, alkoxy group, aryloxy group, acyloxy group, carbamoyl group, sulfo group and arylsulfonyl group.

Still more preferable groups for $X^1$ and $X^2$ other than those represented by —$NR^4R^5$ include a hydrogen atom, halogen atom, normal, branched or cyclic alkyl group, aryl group, acyl group, alkoxycarbonyl group, aryloxycarbonyl group, cyano group, carboxyl group, alkoxy group, aryloxy group, acyloxy group, carbamoyl group, mercapto group and alkylthio group.

At least either $X^1$ or $X^2$ is a group represented by —$NR^4R^5$. $R^4$ and $R^5$ independently represent a group selected from a hydrogen atom, alkyl group, alkenyl group, alkynyl group, aryl group, and a group represented by —C-(=O)-R, —C-(=O)-C(=O)-R, —$SO_2$-R or —SO—R. R represents a group selected from a hydrogen atom, alkyl group, aryl group, heterocyclic group, amino group, alkoxy group and aryloxy group.

For the case that $R^4$ and $R^5$ represent an alkyl group, alkenyl group, alkynyl group or aryl group, they are exemplified as a normal, branched or cyclic alkyl group (e.g. methyl, ethyl, isopropyl, tert-butyl, n-octyl, tert-amyl, 1,3-tetramethylbutyl and cyclohexyl); alkenyl group (e.g. vinyl, allyl, 2-butenyl and 3-pentenyl); alkynyl group (e.g. propargyl group and 3-pentinyl); or aryl group (e.g. phenyl, p-methylphenyl and naphthyl).

For the case that $R^4$ and $R^6$ represent a group represented by —C-(=O)-R, —C-(=O)-C(=O)-R, —$SO_2$-R or —SO—R, R is exemplified as a hydrogen group, alkyl group (e.g. methyl, ethyl, isopropyl, tert-butyl, n-octyl, tert-amyl, 1,3-tetramethylbutyl and cyclohexyl); aryl group (e.g. phenyl, p-methylphenyl and naphthyl); heterocyclic group (e.g. 4-pyridyl, 2-thienyl, 1-methyl-2-pyrrolyl); amino group (e.g. amino, dimethylamino, diphenylamino, phenylamino, 2-pyridylamino); alkoxy group (e.g. methoxy, ethoxy and cyclohexyloxy); or aryloxy group (e.g. phenoxy and 2-naphthoxy).

$R^4$ or $R^5$ is preferably a hydrogen atom, normal, branched or cyclic alkyl group, aryl group, acyl group, alkoxycarbonyl group, aryloxycarbonyl group, sulfamoyl group, carbamoyl group, sulfonyl group or sulfinyl group.

$R^4$ or $R^5$ is more preferably a hydrogen atom, normal, branched or cyclic alkyl group, aryl group, acyl group or sulfonyl group.

An exceptionally preferable combination relates to that either $R^4$ or $R^5$ represents a hydrogen atom and the other represents an alkylsulfonyl group or arylsulfonyl group.

Adjacent groups among $R^1$, $R^2$, $R^3$, $X^1$ and $X^2$ may bind with each other to form a ring.

These substituents may further be substituted with the above-mentioned substituents. For a substituent having a highly acidic hydrogen atom, the substituent may form a salt after releasing a proton by dissociation. Available counter ions to form the salt include a metal ion, ammonium ion and phosphonium ion. The state such that the active hydrogen dissociates can be an effective measure for the case that some consideration is needed as for volatility of the solvent at the time of development of the compound.

For a compound as represented by the formula (1) having only one phenol structure within a molecule, a total carbon number of the substituents is preferably within a range from 1 to 200, more preferably from 1 to 150, and still more preferably from 1 to 100. The total carbon number is not limitative to the above for a compound having a plurality of the phenol structure bound to a polymer chain, in which the whole polymer may have an average molecular weight of 500,000 or less. A compound in a bis form or tris form having a linking group with a carbon number of 1 to 100 is also effective. Using such compound with a larger molecular weight can provide an effective measure for the case that some consideration is needed as for volatility of the solvent at the time of development of such compound.

Preferable examples of the compound used for the present invention and as represented with the general formula (1) are shown below, while not being limited thereto.

A-1

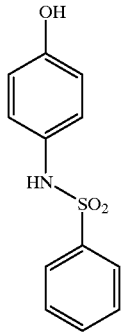

A-2

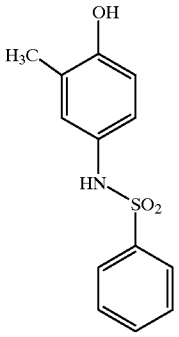

A-3

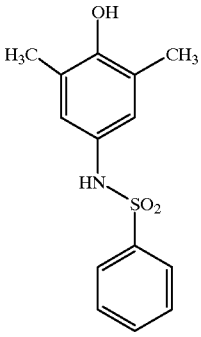

-continued

A-4

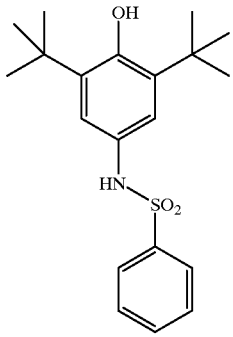

A-5

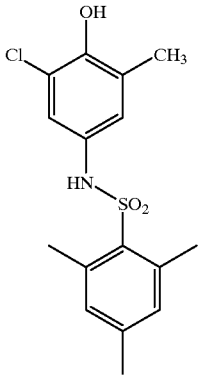

A-6

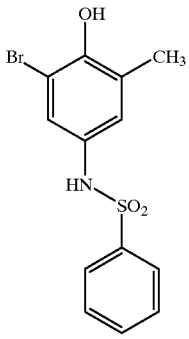

A-7

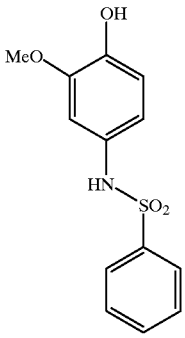

-continued
A-8
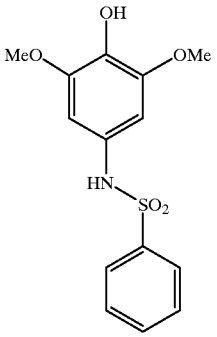
A-9
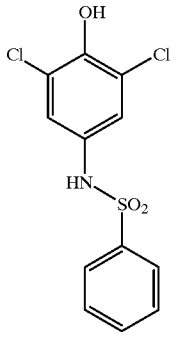
A-10
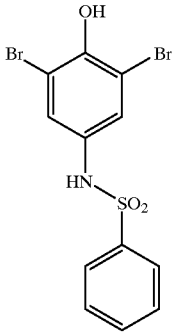
A-11
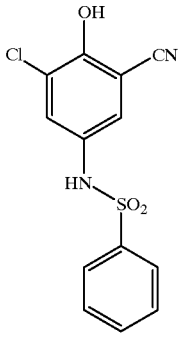
-continued
A-12
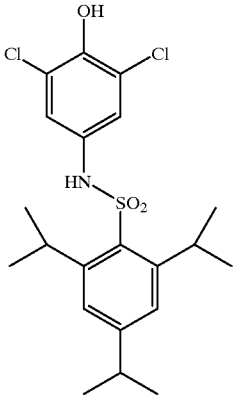
A-13
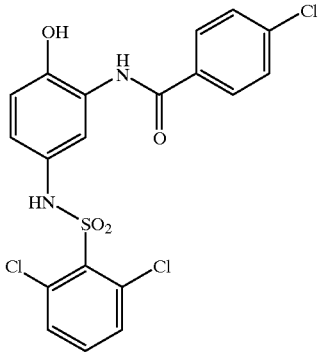
A-14
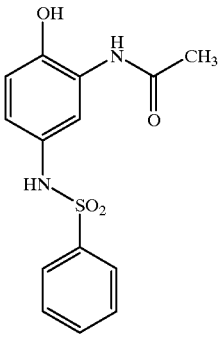
A-15
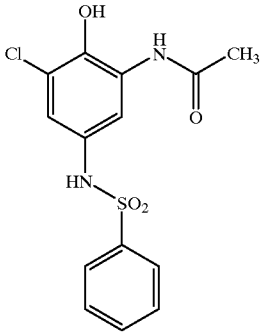

-continued
A-16
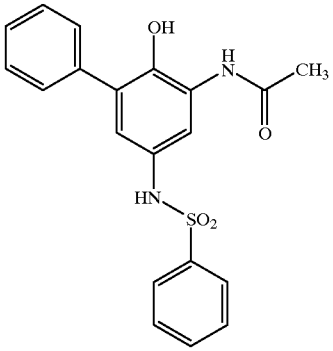
A-17
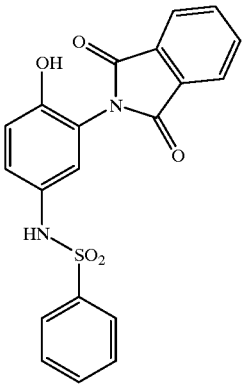
A-18
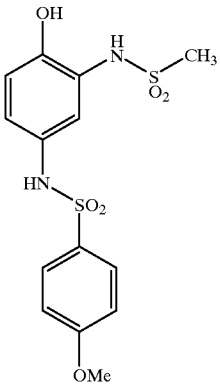
A-19
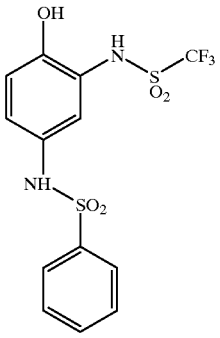
-continued
A-20
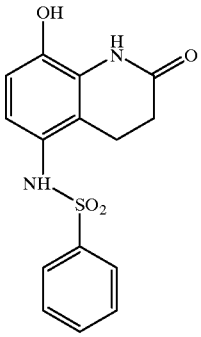
A-21
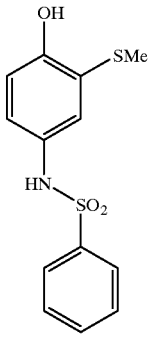
A-22
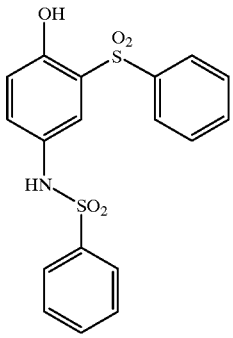
A-23
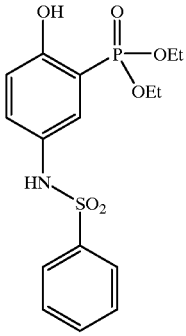

-continued
A-24
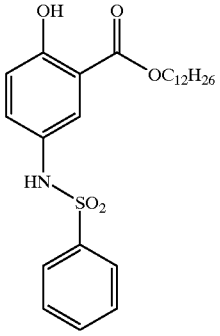
A-25
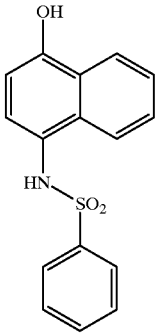
A-26
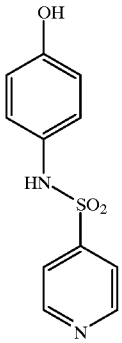
A-27
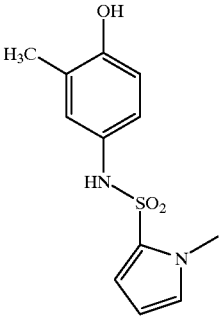
-continued
A-28
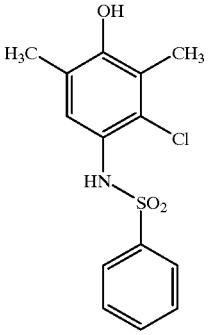
A-29
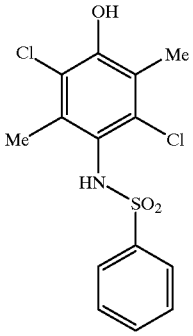
A-30
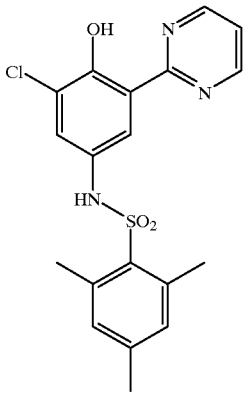
A-31
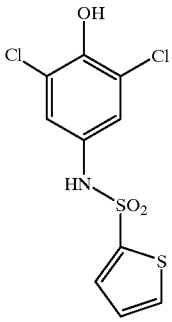

-continued
A-32
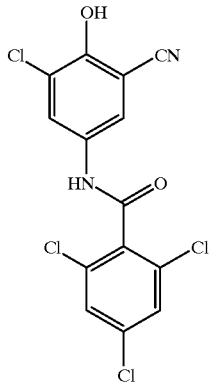
A-33
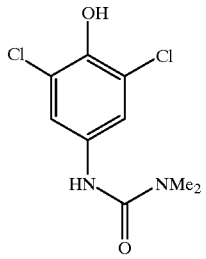
A-34
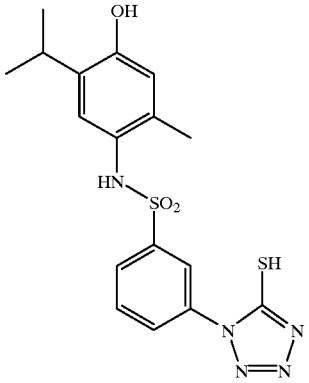
A-35
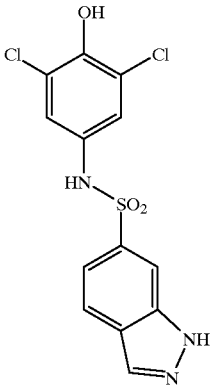
-continued
A-36
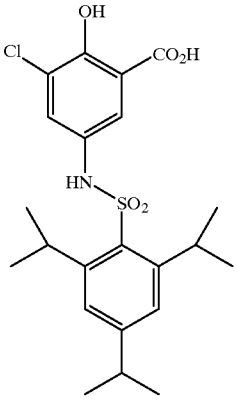
A-37
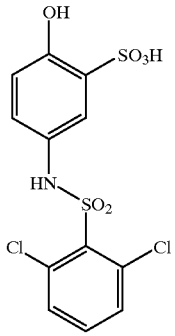
A-38
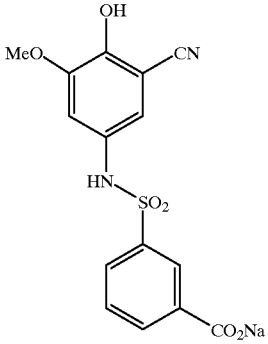
A-39
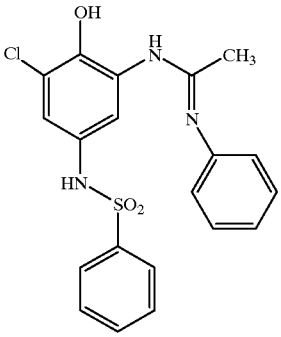

-continued
A-40
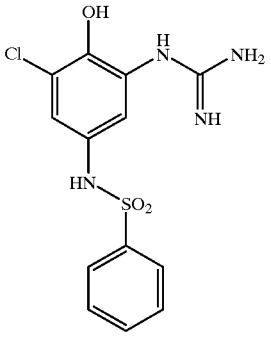
A-41
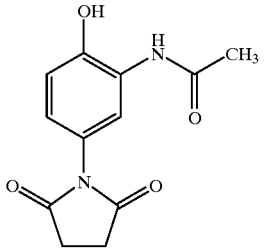
A-42
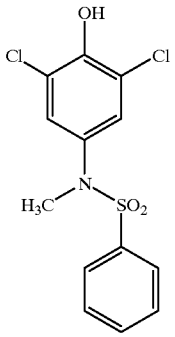
A-43
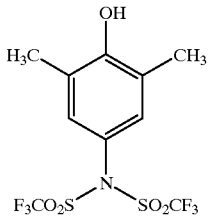
A-44
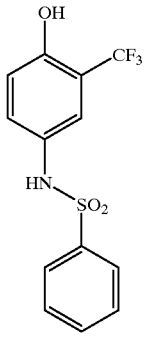
-continued
A-45
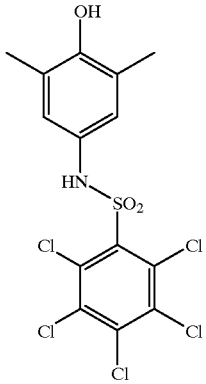
A-46
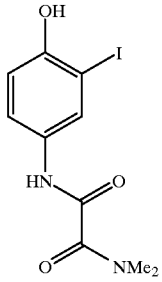
A-47
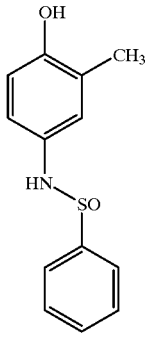
A-48
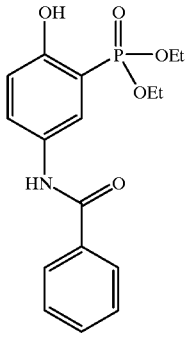

-continued
A-49
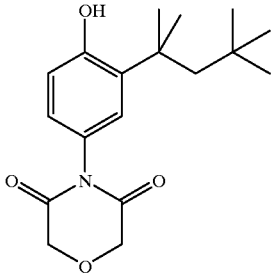
A-50
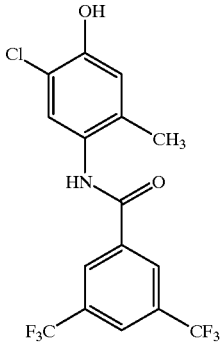
A-51
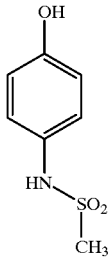
A-52
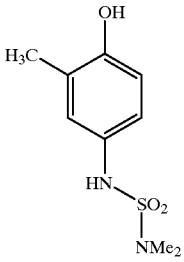
A-53
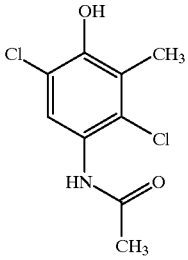
-continued
A-54
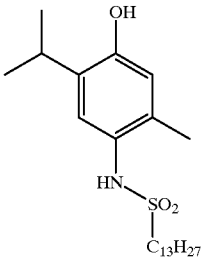
A-55
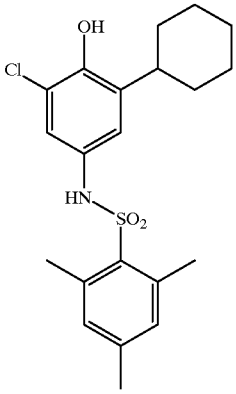
A-56
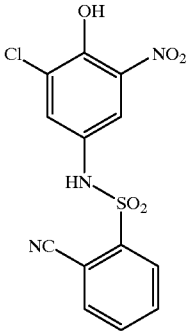
A-57
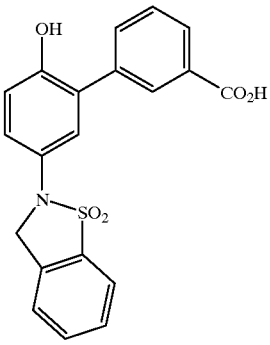

-continued
A-58
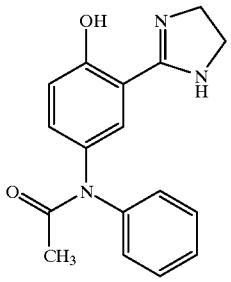
A-59
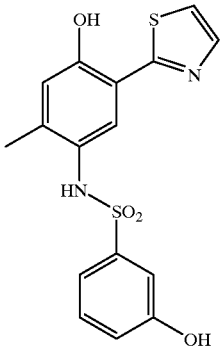
A-60
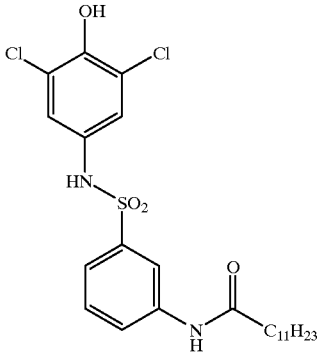
A-61
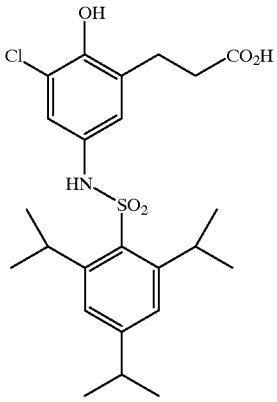
-continued
A-62
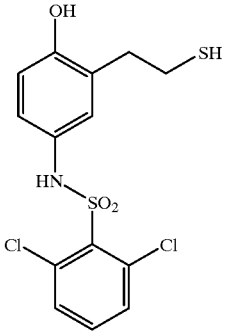
A-63
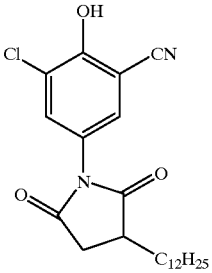
A-64
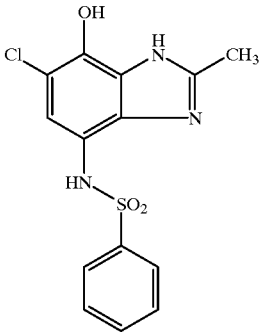
A-65
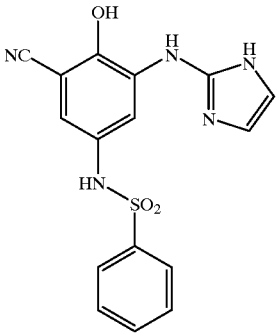

-continued
A-66
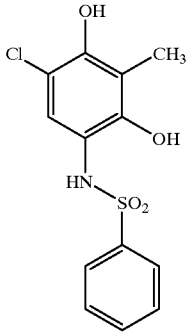
A-67
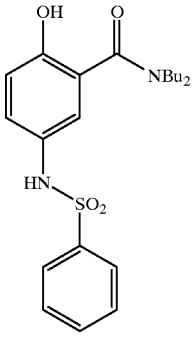
A-68
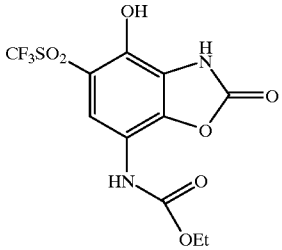
A-69
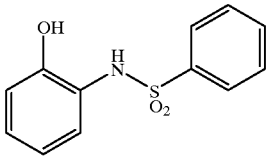
A-70
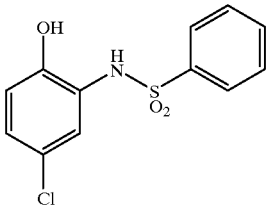
A-71
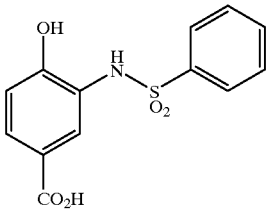
-continued
A-72
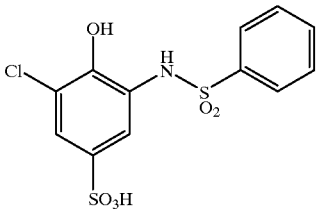
A-73
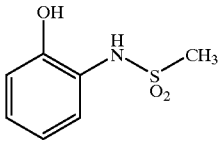
A-74
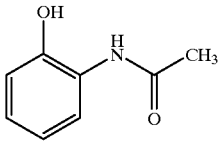
A-75
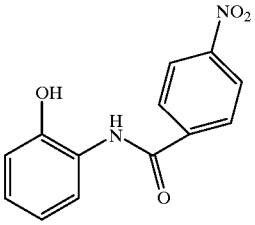
A-76
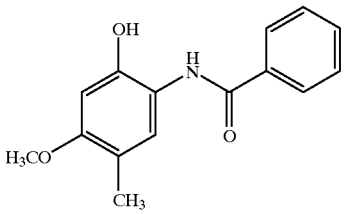
A-77
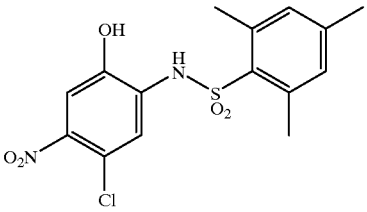
A-78
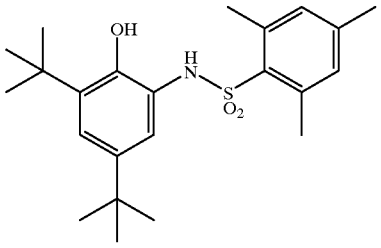

-continued
A-79
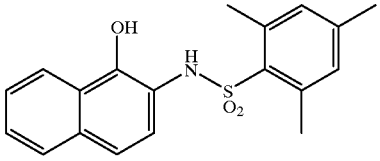
A-80
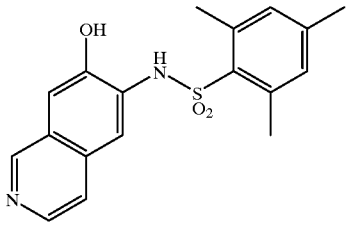
A-81
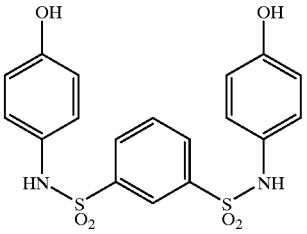
A-82
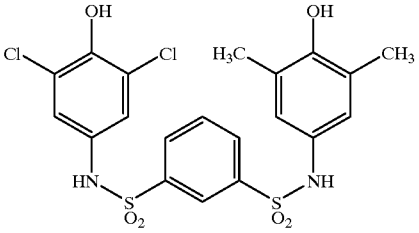
A-83
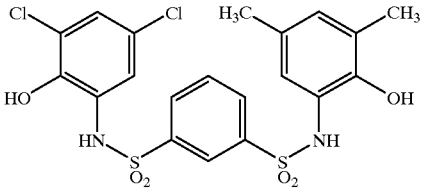
A-84
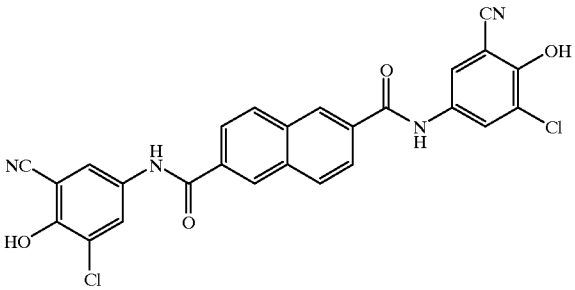
-continued
A-85
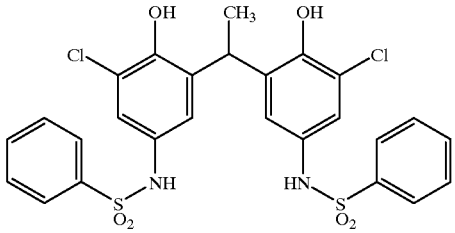
A-86
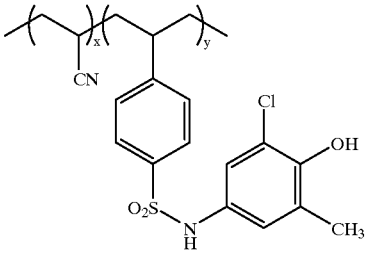
A-87
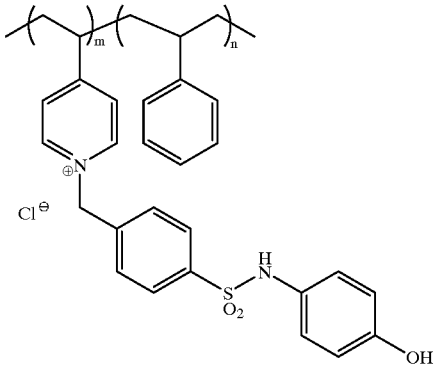
A-88
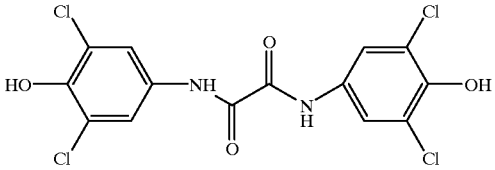
A-89
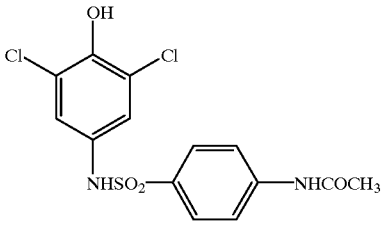
A-90
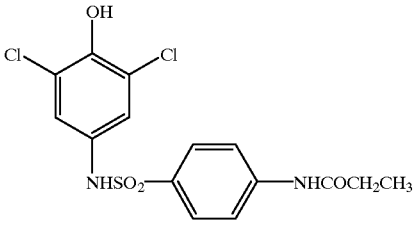

-continued
A-91
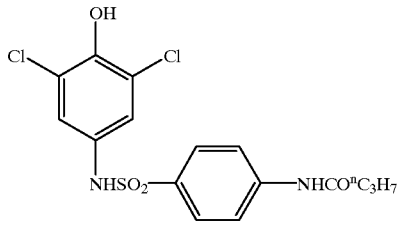
A-92
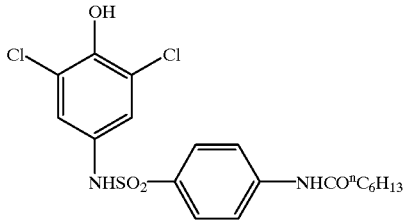
A-93
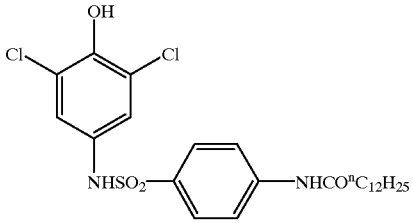
A-94
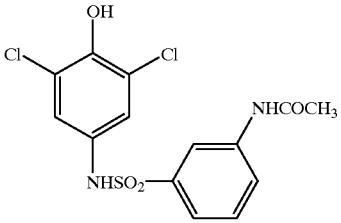
A-95
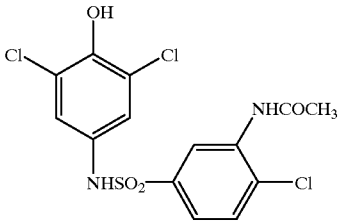
A-96
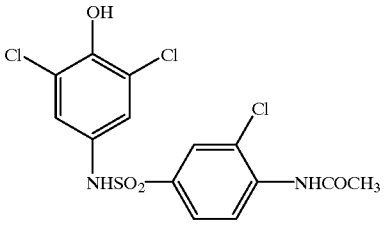
-continued
A-97
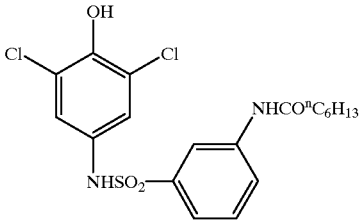
A-98
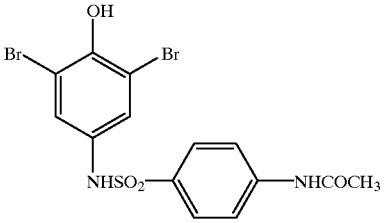
A-99
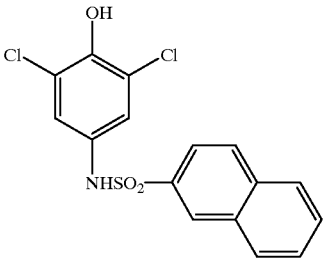
A-100
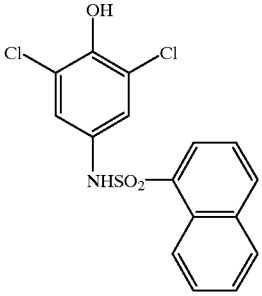
A-101
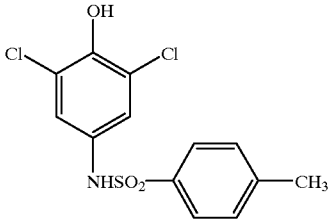
A-102
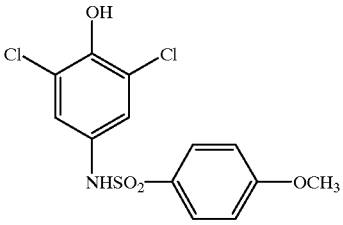

-continued

A-103

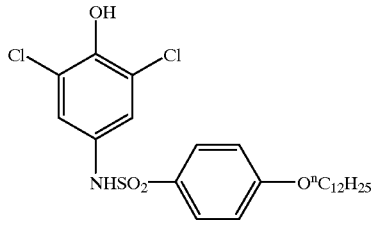

A-104

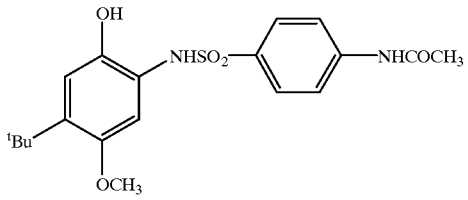

A-105

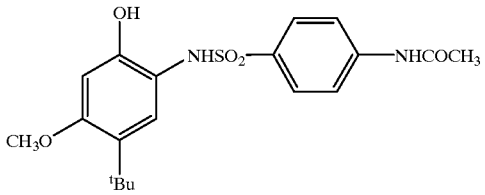

Amount of use of the compound as represented by the general formula (1) is preferably 0.01 to 100 mol % of the reducing agent used, and more preferably 0.1 to 50 mol %, and still more preferably 1 to 20 mol %.

The compound represented by the general formula (1) can be used in the present invention as dissolved in water or other appropriate organic solvents such as alcohols (methanol, ethanol, propanol, fluorinated alcohol), ketones (acetone, methyl ethyl ketone, methyl isobutyl ketone), dimethylformamide, dimethylsulfoxide and Methyl Cellosolve.

The compounds can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball-mill, colloid mill, sand grinder mill, manthone galling, micro-fluidizer or ultrasonic wave.

The compound of the general formula (1) used in the present invention can be added to any layer provided on the same side with the image-forming layer as viewed from a support, that is to the image-forming layer and the layer on the same side therewith, where addition to the image-forming layer or to the layer adjacent thereto is preferable.

While it is not essential for the heat-developable recording material of the present invention to contain an ultrahigh contrast agent, the ultrahigh contrast may be used in a preferred embodiment. Preferable examples of the ultrahigh contrast agent include a substituted alkene derivative, substituted isoxazole derivative and specific acetal compound as represented by the general formulae (2) to (4), respectively. The general formulae (2) to (4) will be described hereinafter.

general formula (2)

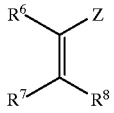

general formula (3)

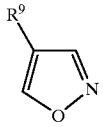

general formula (4)

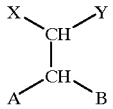

In the general formula (2), $R^6$, $R^7$ and $R^8$ independently represent a hydrogen atom or substituent, and Z represents an electron withdrawing group or silyl group. In the general formula (2), $R^5$ and Z; $R^7$ and $R^8$; $R^6$ and $R^7$; or $R^8$ and Z may bind with each other to form a ring structure. In the general formula (3), $R^9$ represents a substituent. In the general formula (4), X and Y independently represent a hydrogen atom or substituent; and A and B independently represent an alkoxy group, alkylthio group, alkylamino group, aryloxy group, arylthio group, anilino group, heterocyclic oxy group, heterocyclic thio group or heterocyclic amino group. In the general formula (4), X and Y; or Z and B may bind with each other to form a ring structure.]

The compound represented by the general formula (2) will be detailed hereinafter.

In the general formula (2), $R^6$, $R^7$ and $R^8$ independently represent a hydrogen atom or substituent, and Z represents an electron withdrawing group or silyl group. In the general formula (2), $R^6$ and Z; $R^7$ and $R^8$; $R^6$ and $R^7$; or $R^8$ and Z may bind with each other to form a ring structure.

The substituent represented by $R^6$, $R^7$ or $R^8$ is exemplified as a halogen atom (fluorine atom, chlorine atom, bromine atom or iodine atom), alkyl group (including aralkyl group, cycloalkyl group and active methine group), alkenyl group, alkynyl group, aryl group, heterocyclic group (including N-substituted nitrogen-containing heterocyclic group), heterocyclic group containing a quaternized nitrogen atom (e.g. pyridinio group), acyl group, alkoxycarbonyl group, aryloxycarbonyl group, carbamoyl group, carboxyl group or salt thereof, imino group, imino group substituted with nitrogen atom, thiocarbonyl group, sulfonylcarbamoyl group, acylcarbamoyl group, sulfamoylcarbamoyl group, carbazolyl group, oxalyl group, oxamoyl group, cyano group, thiocarbamoyl group, hydroxyl group, alkoxy group (including a group containing repetitive units of ethylenoxy group or propylenoxy group), aryloxy group, heterocyclic group, acyloxy group, (alkoxy or aryloxy)carbonyloxy group, carbamoyloxy group, sulfonyloxy group, amino group, (alkyl, aryl or heterocyclic)amino group, acylamino group, sulfonamide group, ureide group, thioureide group, imido group, (alkoxy or aryloxy)carbonylamino group, sulfamoylamino group, semicarbazide group, thiosemicarbazide group, hydrazino group, quaternized ammonio group, cxamoylamino group, (alkyl or aryl)sulfonylureide group, acylureide group, acylsulfamoylamino group, nitro group, mercapto group, (alkyl, aryl or heterocyclic)thio group, acylthio group, (alkyl or aryl)sulfonyl group, (alkyl or aryl)sulfinyl group, sulfo group or salt thereof, sulfamoyl group, acylsulfamoyl group, sulfonylsulfamoyl group or salt thereof, phosphoryl group, group containing phosphate amide or phosphate ester structure, silyl group and stannyl group.

These substituents may further be substituted by these substituents.

The electron withdrawing group represented by Z in the general formula (2) is such substituent having a positive Hammett's substituent constant $\sigma_p$, which is typified as cyano group, alkoxycarbonyl group, aryloxycarbonyl group, carbamoyl group, imino group, imino group substituted with nitrogen atom, thiocarbonyl group, sulfamoyl group, alkylsulfonyl group, arylsulfonyl group, nitro group, halogen atom, perfluoroalkyl group, perfluoroalkanamide group, sulfonamide group, acyl group, formyl group, phosphoryl group, carboxyl group (or salt thereof), sulfo group (or salt thereof), heterocyclic group, alkenyl group, alkynyl group, acyloxy group, acylthio group, sulfonyloxy group, or aryl group substituted by these electron withdrawing groups. Here, the heterocyclic group is defined as an aromatic or non-aromatic, saturated or unsaturated heterocyclic group, which is typified as a pyridyl group, quinolyl group, quinoxalinyl, pyradinyl group, benzotriazolyl group, imidazolyl group, benzimidazolyl group, hydantoin-1-yl group, succinimido group and phthalimido group.

The electron withdrawing group represented by Z in the general formula (2) may further have another substituent. Another substituent may be the same as that being possible for $R^6$, $R^7$ and $R^8$ in the general formula (2) when $R^6$, $R^7$ and $R^8$ represent substituents.

It is also preferable that $R^6$ and Z; $R^7$ and $R^8$; $R^6$ and $R^7$; or $R^8$ and Z bind with each other to form a ring structure. The cyclic structure thus formed is of non-aromatic carbon ring or non-aromatic hetero ring.

Preferable range of the compound represented by the general formula (2) will be described hereinafter.

The silyl group represented by Z in the general formula (2) is preferably exemplified as a trimethylsilyl group, t-butyldimethylsilyl group, phenyldimethylsilyl group, triethylsilyl group, triisopropylsilyl group and trimethylsilyldimethylsilyl group.

The electron withdrawing group represented by Z in the general formula (2) is preferably such that having a total carbon number of 0 to 30, which is typified as cyano group, alkoxycarbonyl group, aryloxycarbonyl group, carbamoyl group, thiocarbonyl group, imino group, imino group substituted with nitrogen atom, sulfamoyl group, alkylsulfonyl group, arylsulfonyl group, nitro group, perfluoroalkyl group, acyl group, formyl group, phosphoryl group, acyloxy group, acylthio group or phenyl group substituted by arbitrary electron withdrawing group. Among these more preferable are cyano group, alkoxycarbonyl group, carbamoyl group, imino group, sulfamoyl group, alkylsulfonyl group, arylsulfonyl group, acyl group, formyl group, phosphoryl group, trifluoromethyl group or a phenyl group substituted by an arbitrary electron withdrawing group; and still more preferably are cyano group, formyl group, acyl group, alkoxycarbonyl group, imino group and carbamoyl group.

A group represented by Z in the general formula (2) is preferably an electron withdrawing group.

A substituent represented by $R^6$, $R^7$ and $R^8$ is preferably a group with a total carbon number of 0 to 30, which is exemplified as a group based on the same definition as the above-described electron withdrawing group represented by Z in the general formula (2), as well as alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, arylamino group, heterocyclic amino group, ureide group, acylamino group, sulfonamide group or substituted or unsubstituted aryl group.

In the general formula (1), $R^6$ preferably represents an electron withdrawing group, aryl group, alkylthio group, alkoxy group, acylamino group, hydrogen atom or silyl group.

When $R^6$ represents an electron withdrawing group, it preferably has a total carbon number of 0 to 30, and can be exemplified as cyano group, nitro group, acyl group, formyl group, alkoxycarbonyl group, aryloxycarbonyl group, thiocarbonyl group, imino group, imino group substituted with nitrogen atom, alkylsulfonyl group, arylsulfonyl group, carbamoyl group, sulfamoyl group, trifluoromethyl group, phosphoryl group, carboxyl group (or salt thereof) or saturated or unsaturated heterocyclic group. Among these, more preferable are cyano group, acyl group, formyl group, alkoxycarbonyl group, carbamoyl group, imino group, imino group substituted with nitrogen atom, sulfamoyl group, carboxyl group (or salt thereof), or saturated or unsaturated heterocyclic group. Among these, still more preferable are cyano group, formyl group acyl group, alkoxycarbonyl group, carbamoyl group, or saturated or unsaturated heterocyclic group.

When $R^6$ represents an aryl group, it is preferably a substituted or unsubstituted phenyl group with a total carbon number of 0 to 30, the substituent of which being an arbitrary group, and more preferably an electron withdrawing substituent.

In the general formula (2), $R^6$ more preferably represents an electron withdrawing group or aryl group.

In the general formula (2), $R^7$ and $R^8$ preferably represent a group based on the same definition as the above-described electron withdrawing group represented by Z in the general formula (2), as well as alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group, or substituted or unsubstituted phenyl group.

It is more preferable that either $R^7$ or $R^8$ represents a hydrogen atom and the other represents a substituent. Such substituent is preferably an alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group (more specifically, perfluoroalkaneamide group), sulfoneamide group, substituted or unsubstituted phenyl group or heterocyclic group. Still more preferable are hydroxyl group (or salt thereof), mercapto group (or salt thereof), alkoxy group, aryloxy group, heterocyclic oxy group, alkylthio group, arylthio group, heterocyclic thio group, and heterocyclic group; and most preferable are hydroxyl group (or salt thereof), alkoxy group and heterocyclic group.

It is also preferable that Z and $R^6$; or $R^7$ and $R^8$ in the general formula (11) form a cyclic structure. The cyclic structure thus formed is a non-aromatic carbon ring or non-aromatic hetero ring, preferably having a five- to seven-membered cyclic structure, preferably having, together with the substituent thereof, a total carbon number of 1 to 40, and more preferably 3 to 30.

Among the compounds represented by the general formula (2), one more preferable example is a compound in which Z represents any one of cyano group, formyl group, acyl group, alkoxycarbonyl group, imino group and carbamoyl group; $R^6$ represents an electron withdrawing group or aryl group; either $R^7$ or $R^8$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group and heterocyclic group.

Among the compounds represented by the general formula (2), another more preferable example is a compound in which Z and $R^6$ bind with each other to form a non-aromatic five- to seven-membered ring structure; either $R^7$ or $R^8$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group and heterocyclic group. In such a case, Z forming the non-aromatic cyclic structure together with $R^6$ is preferably an acyl group, carbamoyl group, oxycarbonyl group, thiocarbonyl group and sulfonyl group, in which $R^6$ preferably being an acyl group, carbamoyl group, oxycarbonyl group, thiocarbonyl group, sulfonyl group, imino group, imino group substituted with nitrogen atom, acylamino group and carbonylthio group.

The compound represented by the general formula (3) will be described hereinafter.

The substituent represented by $R^9$ in the general formula (3) can be exemplified as that described for $R^6$ to $R^8$ in the general formula (2).

The substituent represented by $R^9$ in the general formula (3) is preferably an electron withdrawing group or aryl group. When $R^9$ represents an electron withdrawing group, a total carbon number of which being preferably 0 to 30, the group can be exemplified as cyano group, nitro group, acyl group, formyl group, alkoxycarbonyl group, aryloxycarbonyl group, alkylsulfonyl group, arylsulfonyl group, carbamoyl group, sulfamoyl group, trifluoromethyl group, phosphoryl group, imino group, and saturated or unsaturated heterocyclic group. Among these, more preferable are cyano group, acyl group, formyl group, alkoxycarbonyl group, carbamoyl group, sulfamoyl group, alkylsulfonyl group, arylsulfonyl group, and heterocyclic group. Among these, still more preferable are cyano group, formyl group, acyl group, alkoxycarbonyl group, carbamoyl group and heterocyclic group.

When $R^9$ represents an aryl group, it is preferably a substituted or unsubstituted phenyl group with a total carbon number of 0 to 30, the substituent of which can be exemplified as that described for $R^6$, $R^7$ and $R^8$ in the general formula (2) for the case that $R^6$, $R^7$ and $R^8$ represent the substituents.

In the general formula (3), $R^9$ is further preferably a cyano group, alkoxycarbonyl group, carbamoyl group, heterocyclic group, or substituted or unsubstituted phenyl group, and most preferably a cyano group, heterocyclic group or alkoxycarbonyl group.

The compound represented by the general formula (4) will be detailed hereinafter.

In the general formula (4), X and Y independently represent a hydrogen atom or substituent; and A and B independently represent an alkoxy group, alkylthio group, alkylamino group, aryloxy group, arylthio group, anilino group, heterocyclic oxy group, heterocyclic thio group or heterocyclic amino group. X and Y; or A and B may bind with each other to form a ring structure.

The substituents represented by X and Y in the general formula (4) can be exemplified as those described for $R^6$ to $R^8$ in the general formula (2). Specific examples thereof include an alkyl group (including perfluoroalkyl group and trichloromethyl group), aryl group, heterocyclic group, halogen atom, cyano group, nitro group, alkenyl group, alkynyl group, acyl group, formyl group, alkoxycarbonyl group, aryloxycarbonyl group, imino group, imino group substituted with nitrogen atom, carbamoyl group, thiocarbonyl group, acyloxy group, acylthio group, acylamino group, alkylsulfonyl group, arylsulfonyl group, sulfamoyl group, phosphoryl group, carboxyl group (and salt thereof), sulfo group (and salt thereof), hydroxyl group (and salt thereof), mercapto group (and salt thereof), alkoxy group, aryloxy group, heterocyclic oxy group, alkylthio group, arylthio group, heterocyclic thio group, amino group, alkylamino group, anilino group, heterocyclic amino group and silyl group.

These substituents may further have another substituent. X and Y may bind with each other to form a cyclic structure, in which both of non-aromatic carbon ring and non-aromatic hetero ring are allowable.

The substituent represented by X or Y in the general formula (4) is preferably a group with a total carbon number of 1 to 40, and more preferably 1 to 30, which is typified as a cyano group, alkoxycarbonyl group, aryloxycarbonyl group, carbamoyl group, imino group, imino group substituted with nitrogen atom, thiocarbonyl group, sulfamoyl group, alkylsulfonyl group, arylsulfonyl group, nitro group, perfluoroalkyl group, acyl group, formyl group, phosphoryl group, acylamino group, acyloxy group, acylthio group, heterocyclic group, alkylthio group, alkoxy group or aryl group.

X or Y in the general formula (4) is more preferably a cyano group, nitro group, alkoxycarbonyl group, carbamoyl group, acyl group, formyl group, acylthio group, acylamino group, thiocarbonyl group, sulfamoyl group, alkylsulfonyl group, arylsulfonyl group, imino group, imino group substituted with nitrogen atom, phosphoryl group, trifluoromethyl group, heterocyclic group or substituted phenyl group; and still more preferably a cyano group, alkoxycarbonyl group, carbamoyl group, alkylsulfonyl group, arylsulfonyl group, acyl group, acylthio group, acylamino group, thiocarbonyl group, formyl group, imino group, imino group substituted with nitrogen atom, heterocyclic group or phenyl group substituted with an arbitrary electron withdrawing group.

It is also preferable that X and Y mutually bind to form a non-aromatic carbon ring or non-aromatic hetero ring. The ring thus formed is preferably of five- to seven-membered, and preferably has a total carbon number of 1 to 40, more preferably 3 to 30. Preferable examples of X and Y thus forming the cyclic structure include an acyl group, carbamoyl group, oxycarbonyl group, thiocarbonyl group, sulfonyl group, imino group, imino group substituted with nitrogen atom, acylamino group and carbonylthio group.

In the general formula (4), A and B independently represent an alkoxy group, alkylthio group, alkylamino group, aryloxy group, arylthio group, anilino group, heterocyclic thio group, heterocyclic oxy group or heterocyclic amino group, which may bind each other to form a cyclic structure.

The group represented by A or B in the general formula (4) preferably has a total carbon number of 1 to 40, more preferably 1 to 30, and may also have additional substituent.

A more preferable case relates to that A and B in the general formula (4) bind with each other to form a cyclic structure. The cyclic structure thus obtained is preferably a five- to seven-membered non-aromatic hetero ring with a total carbon number of 1 to 40, and more preferably 3 to 30. Examples of the bound structures between A and B (—A—B—) include, for example, —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—Ph—O—, —N$(CH_3)$—Ph—S— and —N(Ph)—$(CH_2)_2$—S—.

The compounds represented by the general formulae (2) to (4) used in the present invention may be incorporated with an adsorptive group capable of adsorbing silver halide. Such adsorptive group may be an alkylthio group, arylthio group, thiourea group, thioamide group, mercapto heterocyclic group or triazole group, all of which being disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. The adsorptive group for silver halide may present in a form of a precursor. Such precursor is exemplified as that disclosed in JP-A-2-285344.

The compounds represented by the general formulae (2) to (4) used in the present invention may be incorporated with a ballast group or polymer commonly used in immobile photographic additives such as a coupler. The compound incorporated with the ballast group is one of the preferable examples. The ballast group refers to a group relatively inactive with regard to photographic characteristics having a carbon number of 8 or larger, and can be selected from, for example, alkyl group, aralkyl group, alkoxy group, phenyl group, alkylphenyl group, phenoxy group, alkylphenoxy group and so forth. The polymer can be exemplified as that disclosed in JP-A-1-100530.

The compounds represented by the general formulae (2) to (4) used in the present invention may be incorporated with a cationic group (e.g. a group containing quaternary ammonio group, or nitrogen-containing hetero ring containing a quaternized nitrogen atom); a group containing repetitive units of ethyleneoxy group or propyleneoxy group; (alkyl, aryl or heterocyclic)thio group; or dissociative group capable of dissociating under the presence of base (e.g. carboxyl group, sulfo group, acylsulfamoyl group, carbamoylsulfamoyl group). The compound incorporated with a group containing repetitive units of ethyleneoxy group or propyleneoxy group; or (alkyl, aryl or heterocyclic)thio group is one of the preferable examples. Specific examples of these groups are disclosed in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by the general formulae (2) to (4) used for the present invention are shown below, while not being limited thereto.

B-1

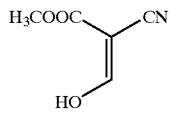

B-2

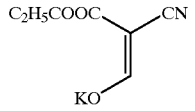

B-3

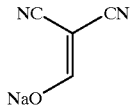

B-4

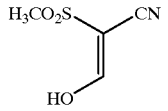

B-5

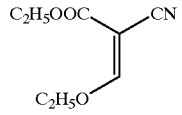

B-6

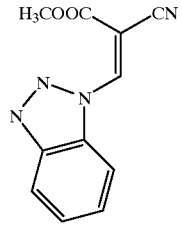

B-7

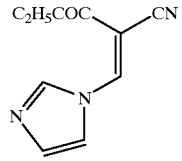

B-8

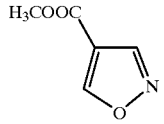

B-9

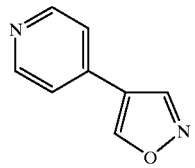

B-10

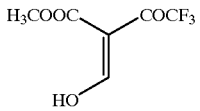

B-11

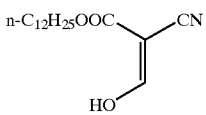

-continued
B-12
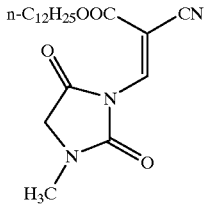
B-13
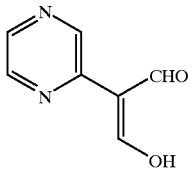
B-14
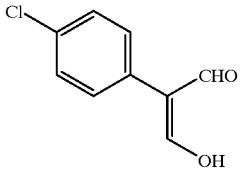
B-15
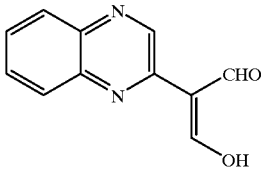
B-16
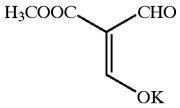
B-17
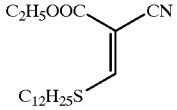
B-18
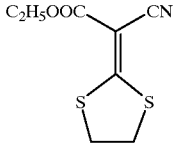
B-19
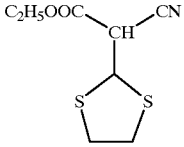
B-20
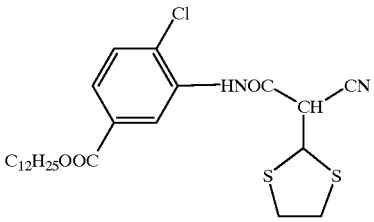
-continued
B-21
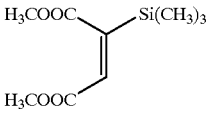
B-22
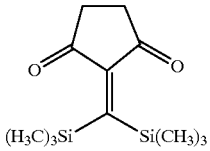
B-23
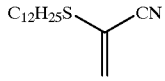
B-24
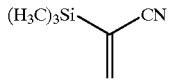
B-25
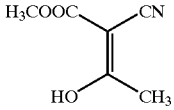
B-26
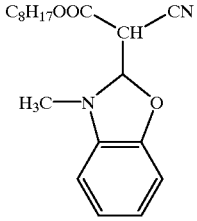
B-27
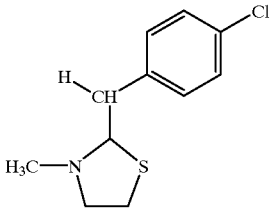
B-28
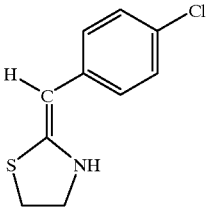
B-29
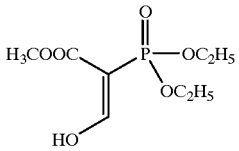

-continued
B-30
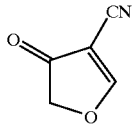
B-31
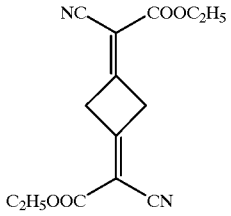
B-32
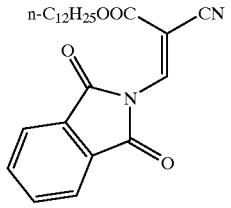
B-33
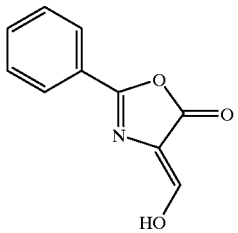
B-34
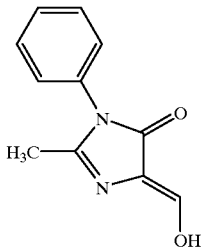
B-35
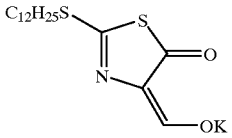
B-36
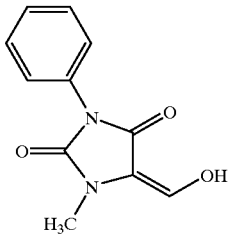
-continued
B-37
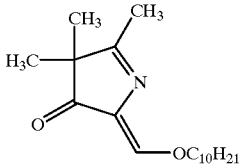
B-38
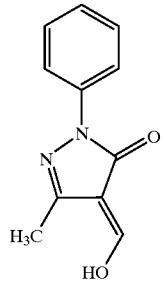
B-39
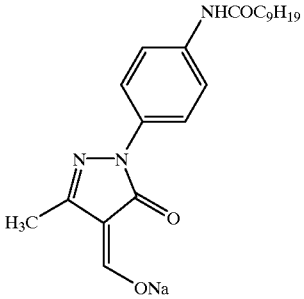
B-40
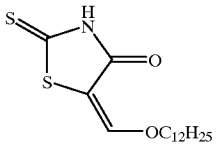
B-41
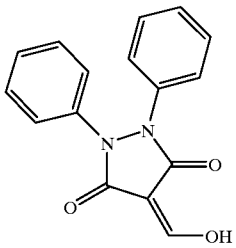
B-42
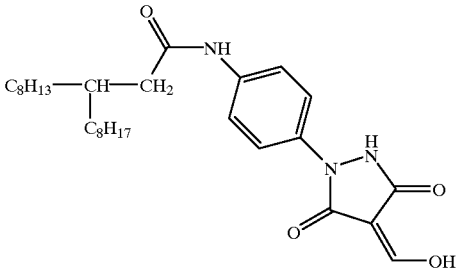

-continued
B-43
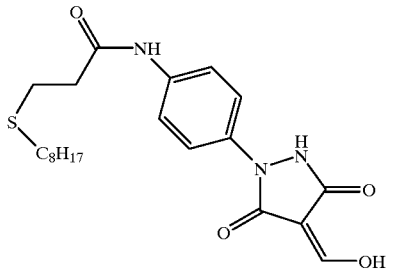
B-44
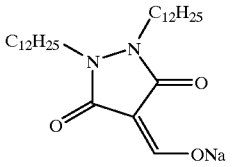
B-45
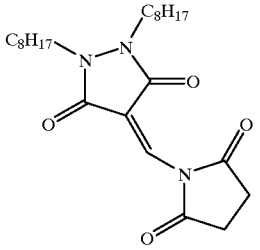
B-46
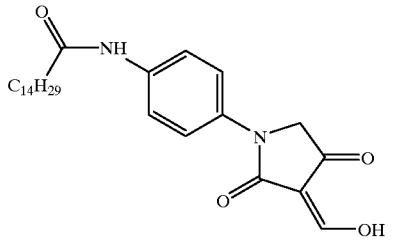
B-47
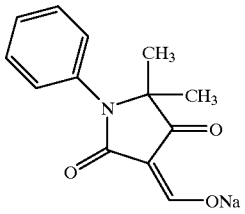
B-48
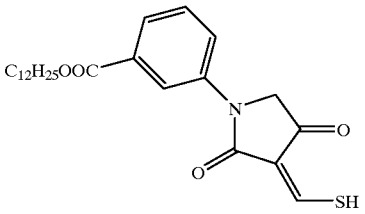
B-49
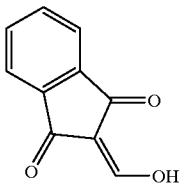
-continued
B-50
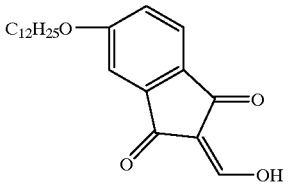
B-51
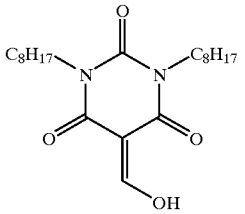
B-52
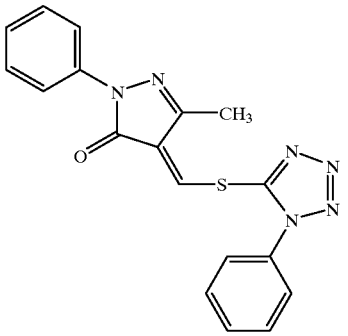
B-53
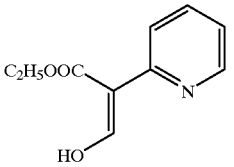
B-54
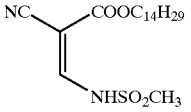
B-55
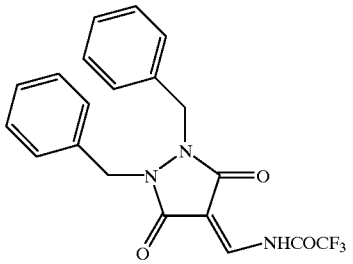
B-56
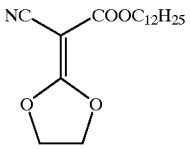

-continued

B-57

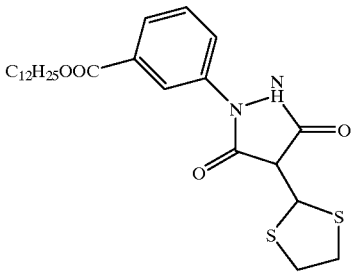

B-58

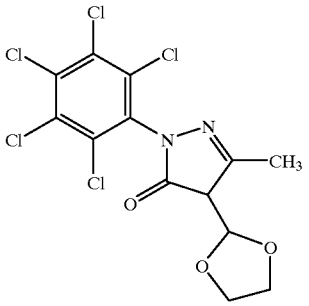

B-59

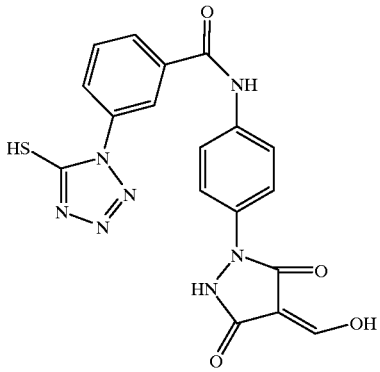

B-60

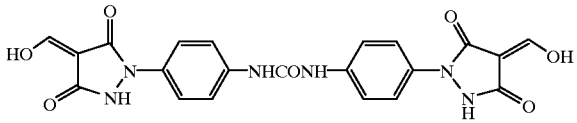

The compounds represented by the general formulae (2) to (4) can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The compounds can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds represented by the general formulae (2) to (4) used in the present invention are dispersed into an appropriate solvent such as water with aid of a ball mill, colloid mill or ultrasonic wave.

The compounds of the general formulae (2) to (4) used in the present invention can be added to any layer provided on the same side with the image-forming layer as viewed from a support, that is to the image-forming layer and the layer on the same side therewith, where addition to the image-forming layer or to the layer adjacent thereto is preferable.

In the present invention, the compounds of the general formulae (2) to (4) are preferably used in an amount, as represented by a molar amount per 1 mole of silver, from $1\times10^{-6}$ to 1 mol, more preferably from $1\times10^{-5}$ to $5\times10^{-1}$ mol, and most preferably from $2\times10^{-5}$ to $2\times10^{-1}$.

The compounds represented by the general formulae (2) to (4) can easily be synthesized according to known methods referring, for example, to U.S. Pat. Nos. 5,545,515, 5,635,339, 5,654,130, International Patent Publication WO 97/34196 or JP-A-9-354107, JP-A-9-309813 and JP-A-9-272002.

The compounds of the general formulae (2) to (4) used in the present invention can be used singly or in combination of two or more, or in combination with a hydrazine derivative or a compound having a quaternary nitrogen atom. As for the hydrazine derivative and the compound having a quaternary nitrogen atom, those disclosed in JP-A-10-221806 are available. These compounds are used at an amount of 100 mol % or less of the compounds represented by the general formulae (2) to (4), preferably 50 mol % or less, and more preferably 20 mol % or less.

The hydrazine derivative and the compound having a quaternary nitrogen atom can be used as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The compounds can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the hydrazine derivative and the compound having a quaternary nitrogen atom are dispersed into water with aid of a ball mill, colloid mill, or ultrasonic wave.

The hydrazine derivative and the compound having a quaternary nitrogen atom can be added to any layer provided on the same side with the image-forming layer as viewed from a support, that is to the image-forming layer and the layer on the same side therewith, where addition to the image-forming layer or to the layer adjacent thereto is preferable.

In the heat-developable recording material of the present invention, a contrast accelerator may be used in combination with the above-described ultrahigh contrast agent so as to produce an ultrahigh contrast image. Examples thereof include amine compounds described in U.S. Pat. No. 5,545,505, specifically AM-1 to AM-5; hydroxamic acids described in U.S. Pat. No. 5,545,507, specifically, HA-1 to HA-11; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

Synthetic method, method for addition, and amount of the addition of the above-described ultrahigh contrast agents and contrast accelerators may comply with those disclosed in the patent publications cited above.

The heat-developable recording material of the present invention contains the reducing agent for reducing the organic silver salt (while excluding a compound represented by the general formula (1)). The reducing agent may be an arbitrary substance capable of reducing silver ion into metal silver, and preferably an organic substance. Conventional photographic developers such as phenidone, hydroquinone and catechol; and reducing agent used for heat development as shown below are useful. The reducing agent is preferably contained at an amount of from 5 to 50 mol % per one mol of silver presents in the face where the image-forming layer is provided, and more preferably from 10 to 40 mol %. A layer to which the reducing agent is added may be any layer on the surface having the image-forming layer. In the case of adding the reducing agent to a layer other than the image-forming layer, the reducing agent is preferably used in a slightly larger amount of from 10 to 50 mol % per one mol of silver. The reducing agent may also be a so-called precursor which is derived to effectively exhibit its function only at the time of development.

For heat-developable recording material using an organic silver salt, a wide variety of reducing agents are known, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,958, 3,679,426, 3,751,252, 3,751,255, 3,761,270, 3,782,949, 3,839,048, 3,928,686 and 5,464,738, German Patent No. 2,321,328 and European Patent No. 692,732. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid, such as a combination of 2,2'-bis(hydroxymethyl)propionyl-β-phenylhydrazine with ascorbic acid; combinations of polyhydroxybenzene with hydroxylamine, reductone and/or hydrazine (e.g. combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; α-cyanophenylacetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of bis-β-naphthol with 1,3-dihydroxybenzene derivative (e.g. 2,4-dihydroxybenzophenone or 2',4'-dihydroxyacetophenone); 5-pyrazolones such as 3-methyl-1-phenyl-5-pyrazolone; reductones such as dimethylaminohexose reductone, anhydrodihydroaminohexose reductone and anydrodihydropiperidonehexose reductone; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols (e.g. tocopherol).

Hindered phenol compound is preferably used as a reducing agent as combined with the compound represented by the general formula (1), which can specifically be selected from the compound group disclosed in JP-A-9-274274 and JP-A-9-304876.

The reducing agent used in the present invention may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

An antifoggant can be used as desired in the heat-developable recording material of the present invention. A number of investigations has been proceeded to suppress fogging in heat-developable photographic silver halide recording material, and for example a mercury salt is disclosed in U.S. Pat. No. 3,589,903. U.S. Pat. No. 4,152,160 discloses carboxylic acids such as benzoic acid and phthalic acid; U.S. Pat. No. 4,784,939 discloses benzoylbenzoic acid compounds; U.S. Pat. No. 4,569,906 discloses indane or tetralin carboxylic acid; U.S. Pat. No. 4,820,617 discloses dicarboxylic acid; and U.S. Pat. No. 4,626,500 discloses hetero aromatic carboxylic acid. U.S. Pat. Nos. 4,546,075, 4,756,999, 4,452,885, 3,874,946, and 3,955,982 disclose halogenated compounds. U.S. Pat. No. 5,028,523 discloses halogen molecule or halogen atom bound to a hetero ring. U.S. Pat. No. 4,103,312 and German Patent No. 1,502,670 disclose palladium compounds; U.S. Pat. No. 4,128,428 discloses metals in the iron family; U.S. Pat. Nos. 4,123,374, 4,129,557, 4,125,430 disclose substituted triazoles; U.S. Pat. Nos. 4,213,784 and 4,245,033 and JP-A-51-26019 disclose sulfur compounds; U.S. Pat. No. 4,002,479 discloses thiouracils; JP-A-50-123331 discloses sulfinic acid; U.S. Pat. Nos. 4,125,403, 4,152,160 and 4,307,187 disclose metal salt of thiosulfonic acid; JP-A-53-20923 and JP-A-53-19825 disclose combined use of metal salt of thiosulfonic acid and sulfinic acid; and JP-B-62-50810 (the code "JP-B" as used herein means an "examined Japanese patent publication"), JP-A-7-209797 and JP-A-9-43760 disclose thiosulfonic acid esters. JP-A-51-42529 and JP-B-63-37368 disclose disulfide compounds.

JP-B-54-165, European Patent Nos. 605,981A and 631,176A, U.S. Pat. Nos. 4,546,075, 4,756,999, 4,452,885, 3,874,946 and 3,955,982 disclose polyhalide compounds. JP-A-10-197989 discloses combined use of polyhalide compound and specific carboxylic acid derivative to suppress fogging.

JP-A-51-26019, JP-A-57-207244, JP-A-60-207140, U.S. Pat. Nos. 2,910,377 and 3,074,809, and JP-A-2-251838 disclose salicylic acid or its derivatives.

In the present invention, polyhalide compound, salicylic acid derivative or thiosulfonic acid derivative is used as an antifoggant. These compounds may be used singly, or in combination of a plurality of compounds within a same category, or in combination of a plurality of compounds in different categories, such as in combination of polyhalide compound and salicylic acid derivative.

The compound used as an antifoggant can be used as dissolved in water or other appropriate organic solvents such as alcohols (methanol, ethanol, propanol, fluorinated alcohol), ketones (acetone, methyl ethyl ketone, methyl isobutyl ketone), dimethylformamide, dimethylsulfoxide and Methyl Cellosolve.

The compound can also be used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill, sand grinder mill, manthone galling, micro-fluidizer or ultrasonic wave.
Specific examples of the antifoggant used in the present invention are shown below, while not being limited thereto.
P-1
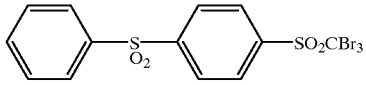
P-2
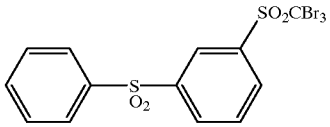
P-3
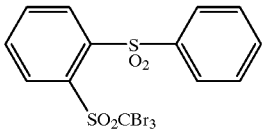
P-4
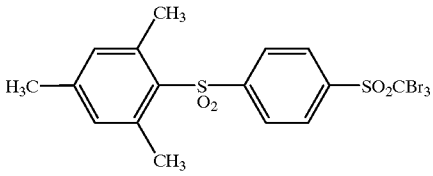
P-5
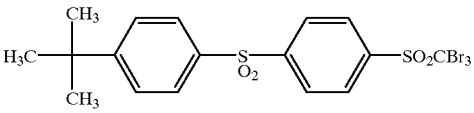
P-6
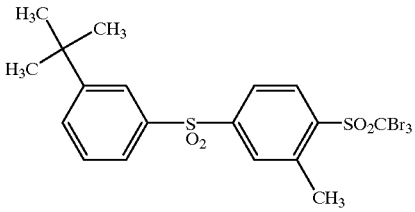
P-7
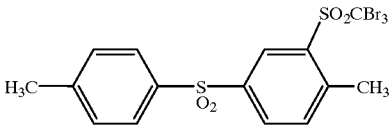
P-8
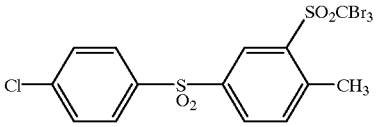
P-9
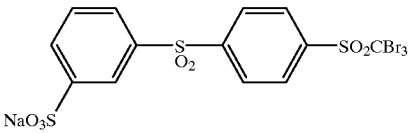
-continued
P-10
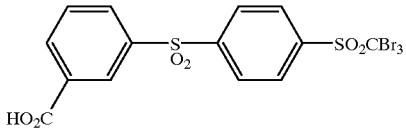
P-11
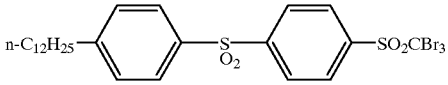
P-12
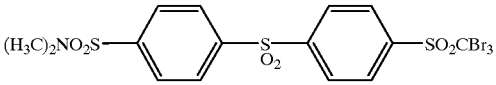
P-13
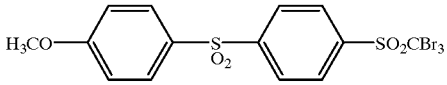
P-14
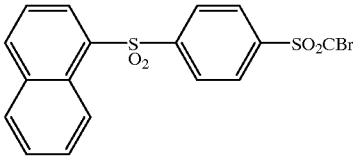
P-15
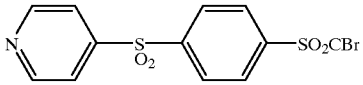
P-16
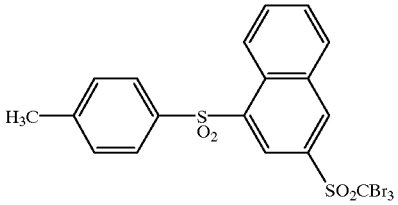
P-17
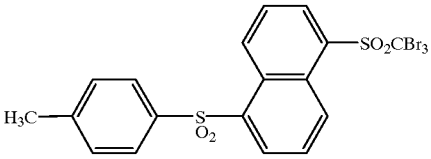
P-18
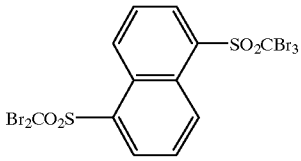
P-19
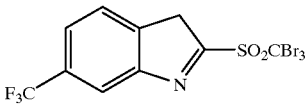
P-20
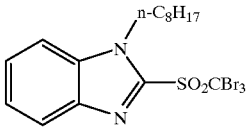

P-21
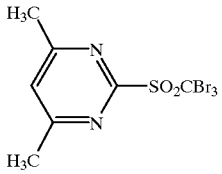
P-22
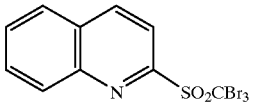
P-23
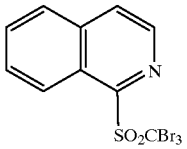
P-24
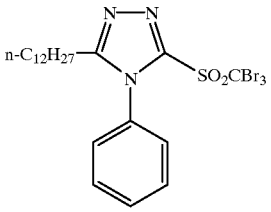
P-25
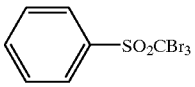
P-26
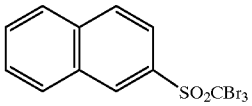
A-1
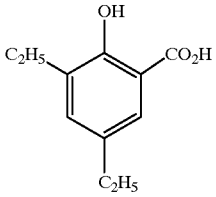
A-2
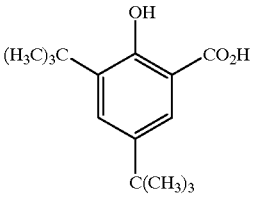
A-3
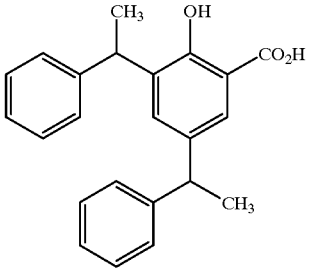
A-4
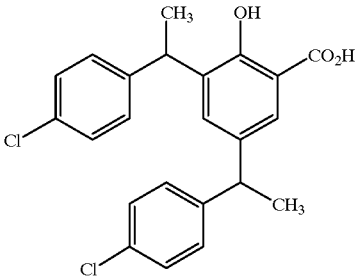
A-5
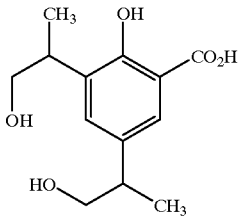
A-6
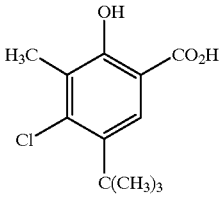
A-7
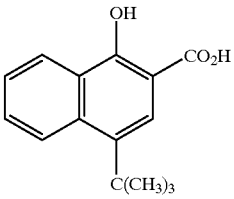
A-8
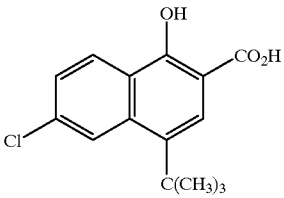

-continued
A-9
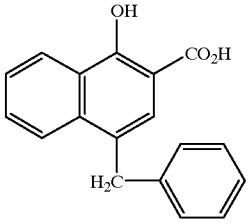
A-10
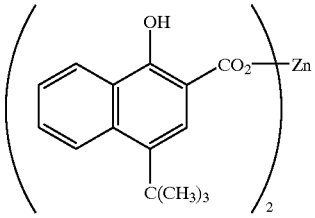
A-11
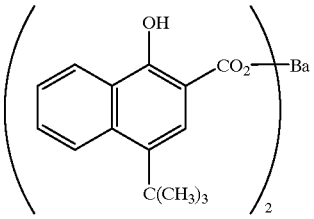
A-12
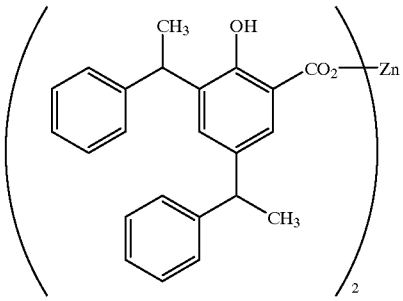
A-13
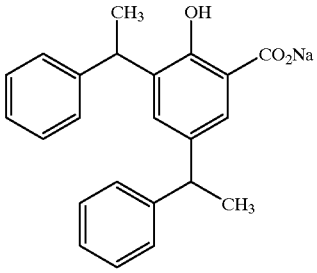
A-14
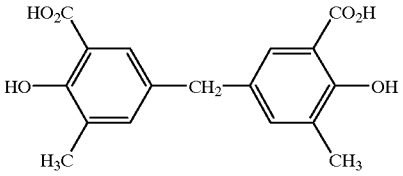
-continued
A-15
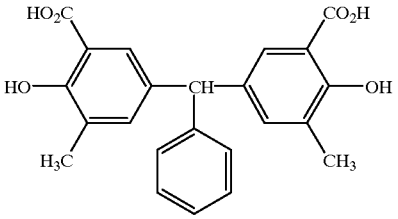
A-16
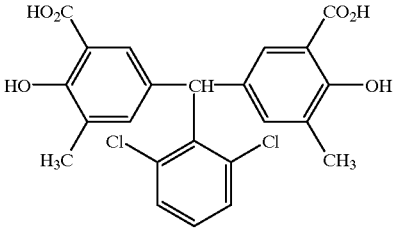
A-17
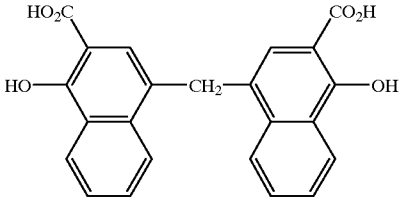
A-18
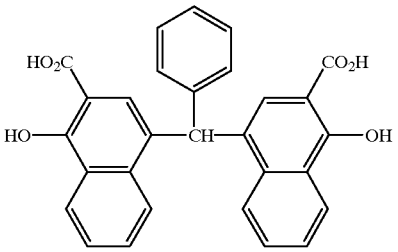
A-19
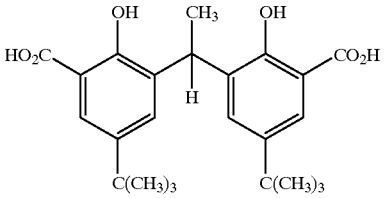
A-20
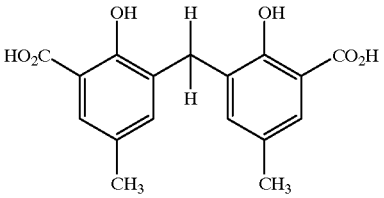
A-21
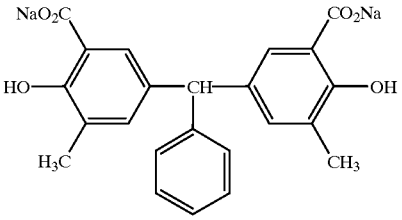

-continued

A-22

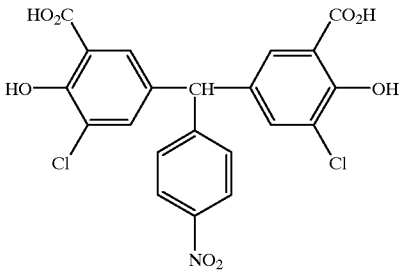

A-23

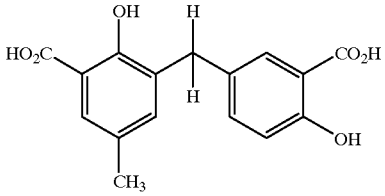

A-24

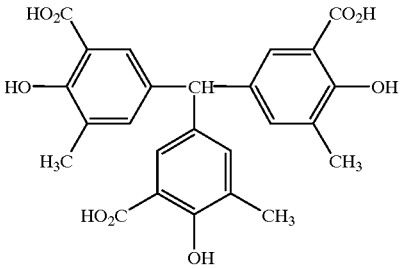

T-1

$CH_3SO_2SNa$

T-2

$CH_3CH_2SO_2SNa$

T-3

$HOOCCH_2CH_2SO_2SNa$

T-4 n-$C_8H_{17}SO_2SNa$

T-5 n-$C_{18}H_{37}SO_2SNa$

T-6 n-$C_4H_9SO_2SKa$

T-7

$(CH_3)_2CHCH_2SO_2SNa$

T-8

$(CH_3)_2CHCH_2CH_2SO_2SNa$

T-9

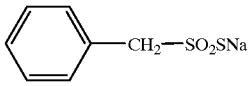

n-$C_8H_{17}SO_2S^-(n\text{-}Bu)_4N^+$

T-10

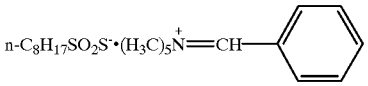

T-11

$H_2NCHCH_2SO_2SH$

T-12

$CH_3OCHCH_2SO_2SNa$

T-13

-continued

T-14

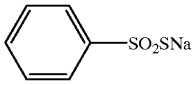

T-15

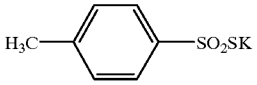

T-16

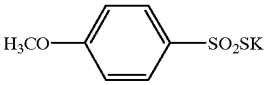

T-17

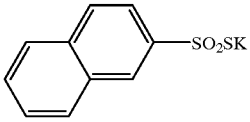

T-18

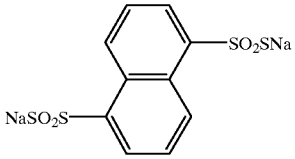

T-19

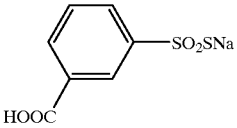

T-20

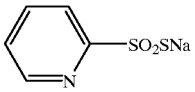

T-21

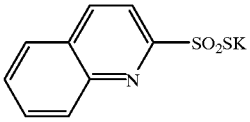

T-22

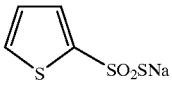

T-23

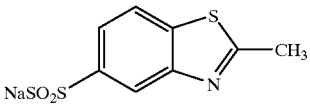

T-24

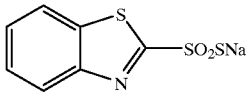

The heat-developable recording material of the present invention preferably contains photosensitive silver halide. The photosensitive silver halide applicable to the present invention will be detailed hereinafter.

The photosensitive silver halide used in the present invention has no limitation with regard to its halogen composition, and any of silver chloride, silver chlorobromide, silver bromide, silver iodobromide and silver iodochlorobromide is available. The halogen composition distribution within the grain may be uniform, or the halogen composition may be changed stepwise or continuously. Silver halide grain with a core/shell structure may preferably be used, in which the structure is preferably of two- to five-fold, and more preferably of two- to four-fold. It is also preferably to adopt a technique for localizing silver bromide on the surface of silver chloride or silver cholorobromide.

Methods for producing photosensitive silver halide used in the present invention are well known in the art, and, for example, the methods described in Research Disclosure, No. 17029 (June 1978) and U.S. Pat. No. 3,700,458 may be applied. The methods applicable to the present invention include such that adding a halogen-containing compound to the prepared organic silver salt to convert a part of silver contained therein into photosensitive silver halide, and such that adding a silver-supplying compound and a halogen-supplying compound to gelatin or other polymer solution to thereby prepare photosensitive silver halide grain which is then mixed with an organic silver salt, where the latter method is more preferable. The photosensitive silver halide grain preferably has a small grain size so as to prevent high white turbidity after image production. Specifically, the grain size is preferably 0.20 $\mu$m or less, more preferably from 0.01 to 0.15 $\mu$m, still more preferably from 0.02 to 0.12 $\mu$m. The term "grain size" as used herein means the length of an edge of the silver halide grain for the case that the grain is a normal crystal having cubic or octahedral shape; and means the diameter of a circle image having an area equal to the projected area of the major plane of the silver halide grain for the case that the grain is tabular; and means the diameter of a sphere having a volume equal to that of the silver halide grain for the case that the grain has other irregular shape such as sphere or rod.

Examples of the shape of the silver halide grain include cubic, octahedral, tabular, spherical, rod and pebble; among these, cubic and tabular shapes being preferred in the present invention. When a tabular silver halide grain is used, the average aspect ratio is preferably from 100:1 to 2:1, more preferably from 50:1 to 3:1. A silver halide grain having rounded corners is also preferably used. The plane indices (Miller indices) of the outer surface plane of a photosensitive silver halide grain is not particularly limited; however, it is preferred that [100] plane showing a high spectral sensitization efficiency upon adsorption of the spectral sensitizing dye occupies a large percentage. The percentage is preferably 50% or above, more preferably 65% or above, still more preferably 80% or above. The percentage of a plane with a Miller index of [100] can be determined by the method described in T. Tani, J. Imaging Sci., 29, 165 (1985), which is based on the plane dependency of adsorption of the sensitizing dye between [111] and [100] planes.

The photosensitive silver halide grain for use in the present invention preferably contains a Group VII metal or Group VIII metal in the Periodic Table, or metal complex. The Group VII metal or Group VIII metal in the Periodic Table, or a center metal of the metal complex is preferably rhodium, rhenium, ruthenium, osmium or iridium. These metal complexes may be used singly, or in combination of two or more complexes of the same or different kinds of metals. The metal complex content is preferably from $1\times10^{-9}$ to $1\times10^{-2}$ mol per one mol of silver, and more preferably from $1\times10^{-8}$ to $1\times10^{-4}$ mol. With respect to the specific structure of the metal complexes, those having the structures described in JP-A-7-225449 may be used.

As the rhodium compound preferably used in the present invention relates to a water-soluble rhodium compound. Examples thereof include a rhodium(III) halide compounds; and rhodium complex salts having a halogen, amines or an oxalates as ligands, such as hexachlororhodium(III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. These rhodium compounds are used in a dissolved form in water or other appropriate solvent, where a method commonly used for stabilizing the rhodium compound solution may be applied, in which an aqueous hydrogen halide solution (e.g. hydrochloric acid, bromic acid, fluoric acid) or alkali halide (e.g. KCl, NaCl, KBr, NaBr) is added. In place of using the water-soluble rhodium, separate silver halide grains predoped with rhodium may be added and dissolved at the time of preparation of silver halide.

The amount of the rhodium compound added is preferably from $1\times10^{-3}$ to $5\times10^{-6}$ mol per one mol of silver halide, and more preferably from $5\times10^{-8}$ to $1\times10^{-6}$ mol.

The rhodium compound may appropriately be added at the time of production of silver halide emulsion grains to at respective stages before coating of the emulsion, where more preferable is to add the compound at the time of emulsion production to be incorporated into the silver halide grain.

Rhenium, ruthenium or osmium for use in the present invention is added in the form of water-soluble complex salt described in JP-A-63-2042, JP-A-1-285941, JP-A-2-20852 and JP-A-2-20855. An exceptionally preferred example thereof refers to a hexacoordinative complex salt represented by the following formula:

$$[ML_6]^{n-}$$

wherein M represents Ru, Re or Os; L represents a ligand; and n represents 0, 1, 2, 3 or 4.

In this case, ammonium or alkali metal ion is used as counter ion, while the ion being of no importance.

Preferred examples of the ligand include halide ligand, cyanide ligand, cyanoxide ligand, nitrosyl ligand and thionitrosyl ligand. Specific examples of the complex for use in the present invention are shown below, while not being limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RUCl_5(NO)]^{2-}$ | $[RuBr_5(NS)]^{2-}$ | |
| $[RU(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The amount of addition of these compounds is preferably from $1\times10^{-9}$ to $1\times10^{-5}$ mol per one mol of silver halide, and more preferably from $1\times10^{-8}$ to $1\times10^{-6}$ mol.

These compounds may be added appropriately at the time of preparation of silver halide emulsion grains or at respective stages before coating of the emulsion, where more preferable is to add the compound at the time of emulsion production to be incorporated into the silver halide grain.

As for adding the compound during the grain formation of silver halide and integrating it into a silver halide grain, applicable methods include such that previously adding an aqueous solution of metal complex powder together with or without NaCl or KCl to a solution of water-soluble salt or water-soluble halide during the grain formation; such that adding the compound as the third solution at the time of simultaneously mixing a silver salt and a halide solution to prepare silver halide grains by the triple jet method; and such that pouring a necessary amount of an aqueous metal complex solution into a reaction vessel during the grain formation. Among these, preferred is a method comprising adding an aqueous solution of metal complex powder together with or without NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. These iridium compounds are used in a dissolved form in water or other appropriate solvent, where a method commonly used for stabilizing the iridium compound solution may be applied, in which an aqueous hydrogen halide solution (e.g. hydrochloric acid, bromic acid, fluoric acid) or alkali halide (e.g. KCl, NaCl, KBr, NaBr) is added. In place of using the water-soluble iridium, separate silver halide grains predoped with iridium may be added and dissolved at the time of preparation of silver halide.

The silver halide grain for use in the present invention may further contain a metal atom such as cobalt, iron, nickel, chromium, palladium, platinum, gold, thallium, copper or lead. As for cobalt, iron, chromium and ruthenium compounds, hexacyano metal complex is preferably used. Specific examples thereof include ferricyanate ion, ferrocyanate ion, hexacyanocobaltate ion, hexacyanochromate ion and hexacyanoruthenate ion, while not being limited thereto. The phase of the silver halide, in which the metal complex is contained, is not particularly limited, and the phase may be uniform or the metal complex may be contained in a higher concentration in the core portion or in the shell portion.

The above-described metal is used preferably in an amount of from $1\times10^{-9}$ to $1\times10^{-4}$ mol per one mol of silver halide. The metal may be added at the time of preparation of the grains through converting it into a metal salt in the form of simple salt, double salt or complex salt.

The photosensitive silver halide grain may be desalted by water washing according to a method known in the art, such as noodle washing and flocculation, but the grain may not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization method may be used singly or in any combination. When these sensitization methods are used in combination, preferable combinations include sulfur and gold sensitizations; sulfur, selenium and gold sensitizations; sulfur, tellurium and gold sensitizations; and sulfur, selenium, tellurium and gold sensitizations.

The sulfur sensitization applied to the present invention is usually performed by adding a sulfur sensitizer and stirring the emulsion at a temperature as high as 40° C. or above for a predetermined time. The sulfur sensitizer may be a known compound and examples thereof include, in addition to the sulfur compound contained in gelatin, various sulfur compounds such as thiosulfates, thioureas, thiazoles and rhodanines, where thiosulfonate and thiourea are preferable. Although the amount of the sulfur sensitizer to be added varies depending upon various conditions such as pH, temperature and grain size of silver halide at the time of chemical ripening, it is preferably from $10^{-7}$ to $10^{-2}$ mol per one mol of silver halide, and more preferably from $10^{-5}$ to $10^{-3}$ mole.

The selenium sensitizer for use in the present invention may be a known selenium compound. The selenium sensitization is usually performed by adding a labile and/or non-labile selenium compound and stirring the emulsion at a temperature as high as 40° C. or above for a predetermined time. Examples of the labile selenium compound include those described in JP-B-44-15748, JP-B-43-13489, JP-A-4-25832, JP-A-4-109240 and JP-A-4-324855. Among these, particularly preferred are those represented by formulae (VIII) and (IX) of JP-A-4-324855.

The tellurium sensitizer for use in the present invention is a compound capable of producing silver telluride, presumably serve as a sensitization nucleus, on the surface or inside of silver halide grain. The rate of the formation of silver telluride in a silver halide emulsion can be examined according to a method described in JP-A-5-313284. Examples of the tellurium sensitizer include diacyl tellurides, bis (oxycarbonyl) tellurides, bis (carbamoyl) tellurides, bis (oxycarbonyl) ditellurides, bis (carbamoyl) ditellurides, compounds having a P=Te bond, tellurocarboxylates, Te-organyltellurocarboxylic esters, di (poly) tellurides, tellurides, tellurols, telluroacetals, tellurosulfonates, compounds having a P-Te bond, Te-containing heterocycles, tellurocarbonyl compounds, inorganic tellurium compounds and colloidal tellurium. Specific examples thereof include the compounds described in U.S. Pat. No. 1,623,499, No. 3,320,069 and No. 3,772,031; British Patents No. 235,211, No. 1,121,496, No. 1,295,462 and No. 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions. However, it is generally from $10^{-8}$ to $10^{-2}$ mol per one mol of silver halide, preferably on the order of from $10^{-7}$ to $10^{-3}$ mol. The conditions for chemical sensitization in the present invention are not particularly restricted. However, in general, pH is from 5 to 8; pAg is from 6 to 11, preferably from 7 to 10; and temperature is from 40 to 95° C., preferably from 45 to 85° C.

Noble metal sensitizers for use in the present invention include gold, platinum, palladium and iridium, and particularly, gold sensitization is preferred. Examples of the gold sensitizers used in the present invention include chlorauric acid, potassium chloroaurate, potassium aurithiocyanate and gold sulfide, which can be used in an amount of approx. $10^{-7}$ to $10^{-2}$ mol per one mol of silver halide.

As for the silver halide emulsion for use in the present invention, production or physical ripening process for the silver halide grain may be performed under the presence of cadmium salt, sulfite, lead salt or thallium salt.

In the present invention, reductive sensitization may be adoptable. Specific examples of the compound used in the reductive sensitization include ascorbic acid, thiourea dioxide, stannous chloride, aminoiminomethanesulfinic acid, hydrazine derivative, borane compound, silane compound and polyamine compound. The reductive sensitization may be performed by ripening the grains while keeping the emulsion at pH 7 or above, or at pAg 8.3 or less. Also, the reductive sensitization may be performed by introducing a single addition portion of silver ion during the formation of the grains.

To the silver halide emulsion for use in the present invention, thiosulfonic acid compound may be added by the method described in European Patent No. 293917A.

In the recording material used for the present invention, a single kind of silver halide emulsion may be used, or two or more kinds of silver halide emulsions (for example, those differ in the average grain size, halogen composition, crystal habit or chemical sensitization conditions) may be used in combination.

The amount of the photosensitive silver halide used in the present invention is preferably from 0.01 to 0.5 mol per one mol of the organic silver salt, more preferably from 0.02 to 0.3 mol, still more preferably from 0.03 to 0.25 mol. Methods for mixing photosensitive silver halide and organic silver salt separately prepared include such that mixing, after completion of the individual preparation, the silver halide grains and the organic silver salt in a high-speed stirrer, ball mill, sand mill, colloid mill, vibrating mill, homogenizer of the like; and such that mixing, at any timing during preparation of the organic silver salt, already-finished photosensitive silver halide to prepare the organic silver salt; while not being limited thereto as far as sufficient effects of the present invention are obtained.

Next, the reducible silver salt used for the heat-developable recording material of the present invention will be explained hereinafter. The organic silver salt used as the reducible silver salt is such that being relatively stable against light exposure but can produce silver image when heated at 80° C. or higher in the presence of light-exposed photocatalyst (e.g. latent image of photosensitive silver halide) and reducing agent. The organic silver salt may be any organic substance containing a source capable of reducing the silver ion. Silver salt of organic acid, in particular, silver salt of long-chained aliphatic carboxylic acid (with a carbon number of 10 to 30, and preferably 15 to 28) is preferred. Complex of organic or inorganic silver salt, whose ligand has a complex stability constant of from 4.0 to 10.0 , is also preferred. The silver-supplying substance may preferably constitute approx. 5 to 70 wt % of the image-forming layer. Preferably organic silver salt includes silver salt of organic compound having carboxyl group. Examples thereof include silver salts of aliphatic carboxylic acid and aromatic carboxylic acid, while not being limited thereto. Preferred examples of the silver salt of the aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof.

Silver salts of compounds having mercapto or thione group and derivatives thereof may also be used as the organic silver salt. Preferred examples of these compounds include silver salt of 3-mercapto-4-phenyl-1,2,4-triazole; silver salt of 2-mercaptobenzimidazole; silver salt of 2-mercapto-5-aminothiadiazole; silver salt of 2-(ethylglycolamido) benzothiazole; silver salts of thioglycolic acids such as silver salt of S-alkylthioglycolic acids (alkyl group of which having a carbon number of 12 to 22); silver salts of dithiocarboxylic acids such as silver salt of dithioacetic acid; silver salt of thioamides; silver salt of 5-carboxyl-1-methyl-2-phenyl-4-thiopyridine; silver salt of mercaptotriazines; silver salt of 2-mercaptobenzoxazole; silver salts of 1,2,4-mercaptothiazole derivatives such as silver salt of 3-amino-5-benzylthio-1,2,4-thiazole as described in U.S. Pat. No. 4,123,274; and silver salts of thione compounds such as silver salt of 3-(3-carboxyethyl)-4-methyl-4-thiazoline-2-thione as described in U.S. Pat. No. 3,301,678. Compounds containing imino group may also be used. Preferred examples of these compounds include silver salt of benzotriazole and derivatives thereof, for example, silver salt of benzotriazoles such as silver methylbenzotriazole; silver salts of halogenated benzotriazoles such as silver 5-chlorobenzotriazole; silver salts of 1,2,4-triazole and 1H-tetrazole, and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited but an acicular crystal form having a short and long axes is preferred. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined based on the image of organic silver salt dispersion observed with a transmission type electron microscope. Another method for determining the monodispersibility is such that obtaining the standard deviation of volume weighted mean diameter of the organic silver salt. The percentage (coefficient of variation) of the value obtained by dividing the standard deviation by the volume weighted mean diameter is preferably 100% or less, more preferably 80% or less, still more preferably 50% or less. The measurement procedures include irradiating laser light to the organic silver salt dispersed in a solution; deriving an autocorrelation function with respect to the time-dependent fluctuation in the scattered light; and thereby obtaining grain size (volume weighted mean diameter).

The organic silver salt used in the present invention is preferably desalted. The desalting method is not particularly limited and a known method may be used. Known filtration methods such as centrifugal filtration, suction filtration, ultrafiltration and flocculation washing based on coagulation may be preferably used.

To obtain a solid dispersion of the organic silver salt with high S/N ratio, small grain size and no coagulation, it is preferable in the present invention to employ a dispersion method in which water dispersion, containing the organic silver salt as an image-forming medium and containing substantially no photosensitive silver salt, is converted into a high-speed flow, and pressure of which is then allowed to drop.

After such process, the water dispersion is mixed with aqueous photosensitive silver salt solution to produce a coating liquid of photosensitive image-forming medium. Using such coating liquid ensures a heat-developable recording material with a low haze, low fog and high sensitivity. On the other hand, presence of the photosensitive silver salt at the time of dispersion through the conversion into high-pressure, high-speed flow tends to result in increased fog and significantly lowered sensitivity. Using organic solvent, in place of water, also tends to raise the haze, increase the fog and lower the sensitivity. In place of mixing the aqueous solution of the photosensitive silver salt, employing the conversion method, in which a part of the organic silver salt in the dispersion is converted into photosensitive silver salt, may lower the sensitivity.

The water dispersion dispersed after converted into the high-pressure, high-speed flow contains substantially no photosensitive silver salt, and content of which is 0.1 mol % or less with respect to the non-photosensitive organic silver salt, and is not subjected to intentional addition of photosensitive silver salt.

Solid dispersion apparatuses and technologies for implementing the above dispersion method are detailed, for example, in "Bunsanka Rheology to Bunsanka Gijutu (Dispersed Rheology and Dispersion Technology)", by Toshio Kajiuchi and Hiroki Usui, 1991, issued by Sinzansha Shuppan, p.357–403; and "Kagaku Kogaku no Sinpo (Advances in Chemical Engineering) Vol.24", ed. Tokai Section, The Society of Chemical Engineers, 1990, issued by Maki Shoten, p. 184–185. According to the dispersion method employed in the present invention, the water dispersion containing at least organic silver salt is fed to a piping while being pressurized with a high-pressure pump, then allowed to pass through a narrow slit, which causes an abrupt pressure drop to the water dispersion and thereby enables fine dispersion.

As for a high-pressure homogenizer available in the present invention, dispersion into fine particles is generally considered to be effected by dispersion force such as (a) "shearing force" generated when dispersoid passes through a narrow gap under high pressure and at high speed, and (b) "cavitation force" generated when the high pressure exerted on the dispersoid is released to the normal pressure. Golling homogenizer has long been known as such kind of dispersion apparatus, in which pressure-fed process solution to be dispersed is converted into a high-speed flow at a narrow gap on a cylinder surface, then rushed to be collided with the peripheral wall, thereby allowing emulsification or dispersion assisted by the impact force. Operating pressure is, in general, selected in a ranger from 100 to 600 kg/cm$^2$, and flow rate in several to 30 m/second. There is also proposed an apparatus such that having a sawtoothed high flow rate portion to increase the number of collision for a higher dispersion efficiency. In recent years, there has also been developed apparatuses allowing dispersion at higher pressure and faster flow rate, which are typified as Microfluidizer (Microfluidex International Corporation) and Nanomizer (Tokushu Kika Kogyo Co., Ltd.).

Dispersion apparatuses appropriate to the present invention include Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all of which manufactured by Microfluidex International Corporation.

Using these apparatuses, water dispersion containing at least organic silver salt is fed to a piping while being pressurized with a high-pressure pump or so, then the dispersion is passed through a narrow slit provided in the piping thereby to apply desired pressure, and then the pressure within the piping is quickly released to recover the atmospheric pressure thereby to cause an abrupt pressure drop of the dispersion. Thus can be obtained the organic silver salt dispersion optimum for the present invention.

In the present invention, it is possible to disperse the organic silver salt so as to attain a desired grain size by properly adjusting the flow rate, pressure difference at the time of the pressure drop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3000 kg/cm$^2$, and more preferably from 1500 to 3000 kg/cm$^2$. The number of repetition of the process is selectable as required. While this is generally selected as once to as much as 10 times, once to as much as 3 times is preferred from the viewpoint of productivity. Raising the temperature of such water dispersion under high pressure is undesirable from the viewpoint of dispersibility and photographic properties, that is, raising the temperature above 90° C. tends to result in increased grain size and increased fogging. It is thus preferably in the present invention to provide a cooling step before the conversion into the high-pressure, high-speed flow and/or after the pressure drop, to maintain the temperature of the water dispersion within a range from 5 to 90° C., more preferably from 5 to 80° C., and still more preferably 5 to 65° C. Providing such cooling step is exceptionally effective when the dispersion is proceeded under the pressure as high as 1500 to 3000 kg/cm$^2$. A cooler is properly selected, depending on the required capacity of heat exchange, from those being equipped with a double pipe or double pipe as combined with a static mixer; shell-and-tube heat exchanger; and coiled heat exchanger. The diameter, wall thickness and material of the pipe are properly be selected, considering the operating pressure, so as to improve the efficiency of the heat exchange. Coolants available for the cooler include well water at 20° C; colt water at 5 to 10° C. fed from a chiller; and, as requested, ethylene glycol/water at −30° C.

In the dispersion process of the present invention, the organic silver salt is preferably dispersed under the presence of a dispersant (dispersion aid) soluble to water-base solvents. The dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers; semisynthetic anionic polymers such as carboxymethylated starch and carboxymethylcellulose; anionic polymers such as alginic acid and pectic acid; compounds disclosed in JP-A-7-350753; known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; naturally occurring polymers such as gelatin and the like. Most preferable are polyvinyl alcohols and water-soluble cellulose derivatives.

The dispersant is generally mixed with the organic silver salt in a form of powder or wet cake before the dispersing operation, and fed as slurry into a dispersion apparatus, whereas the dispersant may also be included in the powder or wet cake by heat treatment or solvent treatment of the dispersant premixed with the organic silver salt. The pH may be controlled with a suitable pH adjusting agent during or after the dispersing operation.

Besides such mechanical dispersing operation, the organic silver salt can preliminarily be dispersed into solvent by pH control, and then can thoroughly be dispersed by altering pH under the presence of the dispersant. The solvent for the preliminary dispersion may be organic solvent, which is generally removed after the thorough dispersion.

The produced dispersion can be stored under stirring in order to prevent precipitation of the microparticles during storage, or stored in a highly viscous state by producing hydrophilic colloid (e.g. jelly state formed with gelatin). Further, it may be added with a preservative in order to prevent germ proliferation during the storage.

In the present invention, the silver salt can be used in a desired amount, which is preferably 0.1 to 5 g/m$^2$ as an amount of silver, and more preferably 1 to 3 g/m$^2$.

The heat-developable recording material of the present invention may contain an additive known as a "color toner" as required. This is because the addition of an additive known as a "color toner" capable of improving the image increases the optical density in some cases, which is advantageous in forming a black image produced by silver. The color toner is preferably contained on the surface having an image-forming layer in an amount of from 0.1 to 50 mol % per one mol of silver, and more preferably from 0.5 to 20% by mole. The color toner may be a so-called precursor which is derived to effectively exhibit the function only at the time of development.

For the heat-developable recording material using an organic silver salt, color toners over a wide range are known and these are disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50- 114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. No. 3,080,254, No. 3,446,648, No. 3,782,941, No. 4,123,282 and No. 4,510,236, British Patent No. 1,380,795 and Belgian Patent No. 841910. Examples of the color toner include phthalimide and N-hydroxyphthalimide; succinimide, pyrazolin-5-one and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethoxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic anhydride); phthalazine, phthalazine derivatives (e.g., 4-(1-naphthyl)phthalazine, 6-chlorophthalazine, 5,7-dimethoxyphthalazine, 6-iso-butylphthalazine, 6-tert-butylphthalazine, 5,7-dimethylphthalazine, and 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic anhydride); quinazolinedione, benzoxazine and naphthoxazine derivatives; rhodium complexes which function not only as a color toner but also as an in situ halide ion source for the formation of silver halide, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxypyrimidine and 2-hydroxy-4-aminopyrimidine; and azauracil and tetraazapentalene derivatives such as 3,6-dimercapto-1,4-diphenyl-1H, 4H-2,3a, 5,6a-tetraazapentalene and 1,4-di(o-chlorophenyl)-3,6-dimercapto-1H,4H-2,3a, 5,6a-tetraazapentalene.

The color toner of the present invention may be added in any form of a solution, powder, solid microparticle dispersion and the like. The solid microparticle dispersion is performed using a known pulverization means (e.g., ball mill, vibrating ball mill, sand mill, colloid mill, jet mill, roller mill). At the time of solid microparticle dispersion, a dispersion aid may also be used.

The binder used for the neat-developable recording material of the present invention [in particular the binder for the image-forming layer (photosensitive layer, emulsion layer)] may arbitrarily be selected from well-known natural and synthetic resins such as gelatin, polyvinyl acetal, polyvinyl chloride, polyvinyl acetate, cellulose acetate, polyolefin, polyester, polystyrene, polyacylonitrile, polycarbonate, and copolymers or terpolymers thereof. Preferable polymers include polyvinylbutyral, butyl ethyl cellulose, methacrylate copolymer, maleic anhydride ester copolymer, polystyrene, and butadiene-styrene copolymer. Two or more of these polymers can be used in combination as required. Such polymer is used at an amount sufficient for support the components, that is, used in a range so that the polymer can function, effectively as a binder. The effective range can properly be determined by those skilled in the art. Based on an estimation that at least the organic silver salt is to be supported, ratio of the binder and organic silver salt is preferably from 15:1 to 1:2, and more preferably 8:1 to 1:1.

At least one layer within the image-forming layer of the heat-developable recording material of the present invention is preferably an image-forming layer containing polymer latex described below at 50 wt % or more of the total binder. The polymer latex may be used not only for the image forming layer but also for the protective layer or back layer. In particular for printing applications under strict control of dimensional changes, it is necessary to use polymer latex for the protective layer and back layer. Here the "polymer latex" is defined as a dispersion in which water-insoluble hydrophobic polymer in a form of fine particles is dispersed in a water-soluble dispersion medium. Allowable is any dispersion status such that the polymer is emulsified in the dispersion medium, emulsion-polymerized, dispersed as micells, or the polymer can be dispersed so that its molecular chain per se disperses when the polymer has, in a part of its body, some hydrophilic structure. The polymer latex available in the present invention is described, for example, in "Gosei Jushi Emulsion (Synthetic Resin Emulsion)", ed. by Taira Okuda and Hiroshi Inagaki, issued by Kobunshi Kanko Kai (1978); "Gosei Latex no O-yo (Applications of Synthetic Latex)", ed. by Takaaki Sugimura, Yasuo Kataoka, Souichi Suzuki and Keiji Kasahara, issued by Kobunshi Kanko Kai (1993); and Soichi Muroi, "Gosei Latex no Kagaku (Chemistry of Synthetic Latex)", issued by Kobunshi Kanko Kai (1970). The dispersed particles preferably have an average particle size of 1 to 50,000 nm, more preferably approx. 5 to 1,000 nm. The particle size distribution of the dispersed particles is not particularly limited, and the dispersed particles may have a broad particle size distribution or a monodisperse particle size distribution.

As the polymer latex for use in the present invention, not only an ordinary uniform-structured polymer latex but also a so-called core/shell type latex is available. In some cases, it is preferred that the core and the shell have different glass transition temperatures.

Peferable range of the glass transition temperature (Tg) of the polymer latex used as the binder in the present invention differ according to its use for the protective layer, back layer or image-forming layer. For use in the image-forming layer, the glass transition temperature is preferably 40° C. or lower, and more preferably from −30 to 40° C., so that the photographically useful material can acceleratingly disperse at the time of heat development. For use in the protective layer and back layer, a glass transition temperature of 25 to 70° C. is preferable since the layers come into contact with various kinds of equipment.

The polymer latex for use in the present invention preferably has a minimum film-forming temperature (MFT) of from −30 to 90° C., more preferably from 0 to 70° C. In order to control the MFT, a film-forming aid may be added. The film-forming aid, also called a plasticizer, refers to an organic compound (usually an organic solvent) capable of lowering the MFT of the polymer latex, which is described in "Gosei Latex no Kagaku (Chemistry of Synthetic Latex)", by Souichi Muroi, issued by Kobunshi Kanko Kai (1970), supra.

The polymer species of the polymer latex for use in the present invention include acrylic resin, vinyl acetate resin, polyester resin, polyurethane resin, rubber-based resin, vinyl chloride resin, vinylidene chloride resin, polyolefin resin or copolymers thereof. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image-forming layer, whereas too large in degraded and undesirable film-forming property.

Specific examples of the polymer latex used as a binder for the image-forming layer of the heat-developable recording material of the preseint invention include methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. Such polymers are also commercially available, which include acrylic resins such as CEBIAN A-4635, 46583 and 4601 (all produced by Dicel Kagaku Kogyo KK) and Nipol Lx811, 814, 821, 820, 857 (all produced by Nippon Zeon KK); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon KK); vinyl chloride resins such as G351, G576 (both produced by Nippon Zeon KK); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, as required, as a blend of two or more thereof.

In the image-forming layer of the heat-developable recording material of the present invention, the polymer latex preferably accounts for 50 wt % or more of the total binder, and more preferably 70 wt % or more.

To the image-forming layer, it is allowable to add, as required, hydrophilic polymer such as gelatin, polyvinyl alcohol, methylcellulose, hydroxypropylcellulose, carboxymethylcellulose, and hydroxypropylmethylcellulose. The amount of addition of these hydrophilic polymers is preferably 30 wt % of less of the total binder of the image-forming layer, and more preferably 15 wt % or less.

It is preferable that the image-forming layer is formed by coating water-base liquid, which is followed by drying. Here, "water-base" in the context of the present invention refers to that water accounts for 60 wt % or more of the solvent (dispersion medium) of the coating liquid. Possible component of the coating liquid other than water may be water-miscible organic solvent such as methanol, ethanol, isopropanol, Methyl Cellosolve, Ethyl Cellosolve, dimethylformaide and ethyl acetate. Specific examples of the solvent composition, besides 100% water, include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in wt %).

Amount of the total binder of the image-forming layer is preferably 0.2 to 30 g/m$^2$, and more preferably 1 to 15 g/m$^2$. The image-forming layer may be added with cross-linking agent for crosslinking or surfactant for improving coating property.

The sensitizing dye used in the present invention may arbitrarily be selected from those capable of spectrally sensitizing the silver halide particles at a desired wavelength region by adhering thereon. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), ibid. Item 1831X (August, 1978, page 437) and also in the reference as cited therein. In particular, sensitizing dyes having a spectral sensitivity suitable for spectral characteristics of light sources of various laser imagers, scanners, image setters, process cameras and the like can advantageously be selected.

Exemplary dyes advantageous for the spectral sensitization to red light from so-called red light sources such as He—Ne laser, red semiconductor laser and red LED, include Compounds I-1 to I-38 disclosed in JP-A-54-18726; Compounds I-1 to I-35 disclosed in JP-A-6-75322; Compounds I-1 to I-34 disclosed in JP-A-7-287338; Dyes 1 to 20 disclosed in JP-B-55-39818; Compounds I-1 to I-37 disclosed in JP-A-62-284343; and Compounds I-1 to I-34 disclosed in JP-A-7-287338.

Spectral sensitization as to the wavelength region of from 750 to 1,400 nm from semiconductor laser light sources can advantageously be obtained with various known dyes such as cyanine dye, merocyanine dye, styryl dye, hemicyanine dye, oxonol dye, hemioxonol dye and xanthene dye. Useful cyanine dyes are those having a basic nucleus such as thiazole nucleus, oxazoline nucleus, pyrroline nucleus, pyridine nucleus, oxazole nucleus, thiazole nucleus, selenazole nucleus or imidazole nucleus. Useful merocyanine dyes are those having the above-described basic nucleus or an acidic nucleus such as thiohydantoin nucleus, rhodanine nucleus, oxazolidinedione nucleus, thiazolinedione nucleus, barbituric acid nucleus, thiazolinine nucleus, malononitrile nucleus or pyrazolone nucleus. Of these cyanine and merocyanine dyes, those having an imino group or a carboxyl group are particularly effective. Such dyes may be appropriately selected from known dyes described, for example, in U.S. Pat. No. 3,761,279, No. 3,719,495 and No. 3,877,943, British Patents No. 1,466,201, No. 1,469,117 and No. 1,422,057, JP-B-3-10391 and JP-B-6-52387, JP-A-5-341432, JP-A-6-194781 and JP-A-6-301141.

The dyes particularly preferably used for the present invention include cyanine dyes having a substituent containing a thioether bond (e.g. those described in JP-A-62-58239, JP-A-3-138538, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054); dyes having a carboxylic acid group (e.g. dyes disclosed in JP-A-3-163440, JP-A-6-301141, and U.S. Pat. No. 5,441,899); merocyanine dyes; polynuclear merocyanine dyes and polynuclear cyanine dyes (those disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-W-A-55-50111, British Patent No. 1,467,638, and U.S. Pat. No. 5,281,515) and the like.

Dyes forming J-band have been disclosed in U.S. Pat. Nos. 5,510,236 and 3,871,887 (Example 5), JP-A-2-96131 and JP-A-59-48753, and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect, or a material which absorbs substantially no visible light but exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-B-49-25500 and JP-B-43-4933, JP-A-59-19032 and JP-A-59-192242, and the like.

The sensitizing dye may be added to the silver halide emulsion by dispersing it directly in the emulsion or may be added to the emulsion after dissolving it in a solvent such as water, methanol, ethanol, propanol, acetone, Methyl Cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide; these solvents being used solely or by mixing.

Furthermore, the sensitizing dye may be added using a method disclosed in U.S. Pat. No. 3,469,987 by which the dye is dissolved in a volatile organic solvent, the obtained solution is then dispersed in water or hydrophilic colloid, and the obtained dispersion is added to the emulsion, methods disclosed in JP-B-44-23389, JP-B-44-27555 and JP-B-57-22091 by which the dye is dissolved in an acid, and then the obtained solution is added to the emulsion as it were or in the form of aqueous solution under the presence of acid or base; methods disclosed in U.S. Pat. Nos. 3,822,135 and 4,006,025 by which the dye, under the presence of surfactant, in a form of aqueous solution or colloid dispersion is added to the emulsion; methods disclosed in JP-A-53-102733 and JP-A-58-105141 by which the dye is dispersed directly in hydrophilic colloid and the obtained dispersion is added to the emulsion, or a method disclosed in JP-A-51-74624 by which the dye is dissolved using a compound capable of red shifting and the obtained solution is added to the emulsion. An ultrasonic wave may also be used in dissolving the dye.

In the preparation of the emulsion, the sensitizing dye may be added in any process steps as far as efficiency of which having been over authorized. For example, in the grain formation process of silver halide and/or before desalting, or during the desalting process and/or the time period from desalting up to the initiation of chemical ripening, as disclosed in U.S. Pat. No. 2,735,766, No. 3,628,960, No. 4,183,756 and No. 4,225,666, JP-A-58-184142 and JP-A-60-196749, or immediately before or during the chemical ripening process, or in the time period after chemical ripening up to coating, as disclosed in JP-A-58-113920. Furthermore, as disclosed in U.S. Pat. No. 4,225,666 and JP-A-58-7629, a single kind of compound per se may be added in parts or the compound in combination with another compound having a different structure may be added in parts, for example, one part is added during grain formation and another part is added during or after the chemical ripening; or one part is added before or during the chemical ripening and another part is added after completion of the chemical ripening. When the compound is added in parts, the compound or combination of the compound added in parts may be altered for each addition process.

The amount of the sensitizing dye used in the present invention may be selected according to the performance such as sensitivity or fog; where it is preferably from $10^{-6}$ to 1 mol per one mol of silver halide in the photosensitive layer, and more preferably from $10^{-4}$ to $10^{-1}$ mol.

The heat-developable recording material of the present invention may contain mercapto compound, disulfide compound or thione compound so as to control the development by inhibiting or accelerating thereof, to improve the spectral sensitization efficiency, or to improve the storage stability before and after the development.

While any structure of mercapto compound may be available in the present invention, such that represented by Ar-SM$^o$ or Ar—S—S—Ar is preferable, wherein M$^o$ represents a hydrogen atom or alkali metal atom; and Ar represents an aromatic ring or condensed aromatic ring containing one or more nitrogen, sulfur, oxygen, selenium or tellurium atoms. Preferable heteroaromatic rings include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g. Br, Cl), hydroxyl, amino, carboxyl, alkyl (e.g. that having one or more carbon atoms, preferably from 1 to 4 carbon atoms), alkoxy (e.g. that having one or more carbon atoms, preferably from 1 to 4 carbon atoms) and aryl (which may also be substituted). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate; N-methyl-N'-[3-(5-mercaptotetrazolyl)phenyl]urea, and 2-mercapto-4-phenyloxazole, while not particularly being limited thereto. The amount of the addition, into the emulsion layer, of the mercapto compounds is preferably from 0.0001 to 1.0 mol per one mol of silver, more preferably from 0.001 to 0.3 mol.

The image-forming layer (photosensitive layer) in the heat-developable recording material of the present invention may contain a plasticizer or lubricant, and examples thereof include polyhydric alcohols (for example, glycerin and diol described in U.S. Pat. No. 2,960,404); fatty acid or ester described in U.S. Pat. Nos. 2,588,765 and 3,121,060; and silicone resin described in British Pat. No. 955,061.

The heat-developable recording material of the present invention may have a surface protective layer for preventing adhesion of the image-forming layer.

Any kind of polymer is available for a binder contained in the surface protective layer, where it is preferable that a polymer having carboxylic acid residues is used at an amount from 100 mg/m$^2$ to 5 g/m$^2$. The polymers having carboxylic acid residues described herein include natural polymers (e.g. gelatin, arginic acid); modified natural polymers (e.g. carboxymethylcellulose, phthalized gelatin); and synthetic polymers (e.g. polymethacrylate, polyacrylate, polyalkylmethacrylate/acrylate copolymer, polystyrene/polymethacrylate copolymer). Contents of the carboxylic acid residues in these polymers are preferably 10 nmol to 1.4 mol per 100 g of polymer. The carboxylic acid residues can form salts with, for example, alkali metal ion, alkali earth metal ion and organic cation.

Any kind of adhesion preventive material is available for the surface protective layer in the present invention. Examples of the adhesion preventive material include wax; silica particle; styrene-containing elastomeric block copolymer (e.g. styrene-butadiene-styrene, styrene-isoprene-styrene); cellulose acetate; cellulose acetate butylate; cellulose propionate; and mixtures thereof. The surface protective layer may also contain a crosslinking agent for crosslinking, and surfactant for improving coating property.

The image-forming layer and the protective layer therefor in the present invention may contain a photographic element comprising a light absorbing substance and filter dye as described in U.S. Pat. No. 3,253,921, No. 2,274,782, No. 2,527,583 and No. 2,956,879. It is also allowable to dye through mordanting as described, for example, in U.S. Pat. No. 3,282,699. The filter dye is preferably used in an amount so as to attain an absorbance of 0.1 to 3, and more preferably 0.2 to 1.5.

The image-forming layer (photosensitive layer) of the present invention may contain a dye or pigment of various types so as to improve the color tone or prevent the irradiation. Any due or pigment may be used in the photosensitive layer, and examples thereof include pigments and dyes listed in the Color Index. Specific examples thereof include organic pigments and inorganic pigments such as pyrazoloazole dye, anthraquinone dye, azo dye, azomethine dye, oxonol dye, carbocyanine dye, styryl dye, triphenylmethane dye, indoaniline dye, indophenol dye and phthalocyanine. Preferred examples of the dye for use in the present invention include anthraquinone dyes (e.g. Compounds 1 to 9 described in JP-A-5-341441, Compounds 3-6 to 3-18 and 3-23 to 3-38 described in JP-A-5-165147), azomethine dyes (e.g. Compounds 17 to 47 described in JP-A-5-341441), indoaniline dyes (e.g. Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). The dye may be added in any form of solution, emulsified product or solid microparticle dispersion or may be added in the state mordanted with a polymer mordant. The amount of such compounds used may be determined according to desired absorbance, and, in general, the compounds are preferably used in an amount of from $1\times10^{-6}$ to 1 g per 1 m$^2$ of the photosensitive material.

The heat-developable recording material of the present invention is preferably of a so-called single-sided type comprising a support having on one side thereof at least one photosensitive layer (image-forming layer) containing a silver halide emulsion and on the other side thereof a back layer.

In the present invention, the back layer preferably has a maximum absorption in a desired wavelength region of from approx. 0.3 to 2.0. For the desired wavelength region of 750 to 1400 nm, the back layer is preferably an antihalation layer with an optical density within a wavelength region from 360 to 750 nm or 0.005 or larger and less than 0.5, and more preferably 0.001 or larger and less than 0.3. For the desired wavelength region of 750 nm or shorter, the back layer is preferably an antihalation layer with a maximum optical density within such desired wavelength region before image formation of 0.3 to 2.0, and with an optical density within a wavelength region from 360 to 750 nm after the image formation of 0.005 or larger and less than 0.3. There is no limitation on the method for lowering the optical density into the above-described range after the image formation, where possible methods include such that using heat-assisted fading of dye color described in Belgian Patent No. 733,706, and that decreasing the density by photoirradiation-assisted fading described in JP-A-54-17833.

In the case when an antihalation dye is used in the present invention, the dye may be any compound so long as the compound has a desired absorption in the desired wavelength region, the absorption in the visible wavelength region can sufficiently be reduced after the processing, and the back layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is faded after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-2-41734 and U.S. Pat. No. 4,088,497 No. 4,283,487, No. 4,548,896 and No. 5,187,049.

The binder preferably applied to the back layer in the present invention is transparent or semi-transparent, color-less in general, and can be made of natural polymer synthetic resin, polymer and copolymer, as well as other film-forming media such as gelatin, gum arabic, poly(vinyl alcohol), hydroxyethylcellulose, cellulose acetate, cellulose acetate butylate, poly(vinylpyrrolidone), casein, starch, poly(acrylic acid), poly(methyl methacrylate), poly(vinyl chloride), poly (methacrylic acid), copoly(styrene-maleic anhydride), copoly(styrene-acrylonitrile), copoly(styrene-butadiene), polyvinyl acetals (such as poly(vinylformal) and poly (vinylbutyral)), polyesters, polyurethanes, phenoxy resin, poly(vinylidene chloride), polyepoxides, polycarbonates, poly(vinyl acetate), cellulose esters and polyamides. The binder may also be formed by coating from water, organic solvent or emulsion.

For the single-sided recording material in the present invention, a matting agent may be added into the surface protective layer of the photosensitive emulsion layer and/or back layer, or into the surface protective layer for the back layer. The matting agent appears, in general, as organic or inorganic fine particles insoluble to water. Arbitrary matting agents are available, examples of which include organic matting agents disclosed in U.S. Pat. No. 1,939,213, No. 2,701,245, No. 2,322,037, No. 3,262,782, No. 3,539,344 and No. 3,767,448; and inorganic matting agents disclosed in U.S. Pat. No. 1,260,772, No. 2,192,241, No. 3,527,206, No. 3,370,951, No. 3,523,022 and No. 3,769,020; all of which being well known in the related art. More specifically, the organic compounds available as the matting agent include water-dispersible vinyl polymers such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; cellulose derivatives such as methylcellulose, cellulose acetate, and cellulose acetate propionate; starch derivatives such as carboxystarch, carboxynitrophenylstarch, and urea-formaldehydestarch reaction product; gelatin hardened with a known hardening agent; and hardened gelatin in a form of fine capsulated hollow particle obtained by coacervate hardening. Preferable examples of the inorganic compounds include silicon dioxide, titanium dioxide, magnesium dioxide, aluminum oxide, barium sulfate, calcium carbonate, silver chloride desensitized by a known method, silver bromide similarly processed, glass and diatom earth. Different kinds of the matting agent may be combined for use as required. There are no special limitation on the size and morphology of the matting agent, and that having an arbitrary diameter is available. For implementing the present invention, it is preferable to use a matting agent with 0.1 to 30 μm diameter. Both of wide and narrow particle size distributions of the matting agent are allowable. Since the matting agent largely affects the haze and surface gloss of the photosensitive material, the particle size, morphology and particle size distribution of which are preferably selected as required at the time of preparation of the matting agent, or sometimes by mixing two or more matting agents.

A preferable embodiment of the present invention relates to adding the matting agent to the back layer, where the degree of matting of the back layer is preferably expressed as a Bekk smoothness of 10 to 1200 seconds, and more preferably 50 to 700 seconds.

In the present invention, the matting agent is preferably added to an outermost layer or a layer functions as the outermost layer of the recording material, or to a layer provided near the outer surface thereof, and in particular to a layer functions as a so-called protective layer. While there is no special limitation on the degree of matting so long as stardust failure does not occur, the Bekk smoothness falls preferably within a range from 500 to 10,000 seconds, and more preferably 500 to 2,000 seconds.

The photosensitive emulsion layer (image-forming layer) in the heat-developable recording material of the present invention is composed on the support in one or more layers. In the monolayer composition, the layer must contain organic silver salt, photosensitive silver halide, reducing agent and binder, and may additionally contain color toner, coating aid and other auxiliary agents as required. In the double-layer composition, a first emulsion layer (usually adjacent to the substrate) must contain an organic silver salt and a silver halide, and a second layer or both layer must contain some other components. Alternative double-layer composition may be allowable in which a single emulsion layer contains all components and a protective topcoat is provided thereon. A multicolor photosensitive heat-developable photographic material may have a structure such that a combination of the above-described two layers is provided for the respective colors, or, as described in U.S. Pat. No. 4,708,928, a structure such that a single layer contains all components. In the case of a multi-dye multicolor photosensitive heat-developable photographic material, the respective emulsion layers are generally kept away from each other by using a functional or non-functional barrier layer between the respective emulsion layers (photosensitive layers) as described in U.S. Pat. No. 4,460,681.

A backside resistive heating layer described in U.S. Pat. Nos. 4,460,681 and 4,374,921 may also be used in the heat-developable photosensitive photographic imaging system of the present invention.

In the present invention, layers such as the image-forming layer (photosensitive layer), protective layer and back layer each may contain a hardening agent. Examples of the hardening agent include polyisocyanates described in U.S. Pat. No. 4,281,060 and JP-A-6-208193; epoxy compounds described, for example, in U.S. Pat. No. 4,791,042; and vinyl sulfone-based compounds described, for example, in JP-A-62-89048.

Surfactants may preferably used in the present invention to improve the coating property and electric charging. Nonionic, anionic, cationic, fluorine-containing, and any other types of surfactants are properly available. More specifically, they are exemplified as fluorine-containing polymer surfactants disclosed, for example, in JP-A-62-170950 and U.S. Pat. No. 5,380,644; fluorine-containing surfactants disclosed, for example, in JP-A-60-244945 and JP-A-63-188135; polysiloxane-base surfactants disclosed, for example, in U.S. Pat. No. 3,885,965; polyalkylene oxide disclosed, for example, in JP-A-6-301140; and anionic surfactants.

The heat-developable photographic emulsion in the present invention may be coated on a variety of supports. Typical supports include polyester film, undercoat polyester film, poly(ethylene terephthalate) film, poly(ethylene naphthalate) film, cellulose nitrate film, cellulose ester film, poly(vinyl acetal) film, polycarbonate film and related resin material, glass, paper and metal. Typically used are flexible materials such as baryta and/or partially acetylated paper support, and in particular paper support coated with α-olefin polymer; α-olefin polymer being such that having a carbon number of 2 to 10, such as polyethylene, polypropylene and ethylene-butene copolymer. Both of transparent and opaque supports are allowable, the former being more preferable. Among these, exceptionally preferable is polyethylene terephthalate (PET) film of approx. 75 to 200 μm thick processed by biaxial stretching.

In general, plastic film will alter its dimension when passed through a heat developing apparatus for processes at 80° C. or above. Such dimensional change will raise a critical problem in precision multicolor printing when the processed film is used for printing plate making. It is therefore preferable in the present invention to use a film with less dimensional change devised so that the residual internal distortion in the film is relieved during the biaxial stretching to prevent distortion by heat shrinking during the heat development. Preferably used is a polyethylene terephthalate film subjected to heat treatment at 100 to 210° C. before the heat-developable photographic emulsion is coated thereon. Materials with high glass transition temperature are also preferably used, and such materials include polyether ethyl ketone, polystyrene, polysulfone, polyethersulfone, polyarylate and polycarbonate.

The heat-developable photosensitive material of the present invention may have, for an antistatic purpose, a layer containing or comprising soluble salts (e.g. chloride, nitrate); vapor-deposited metal; ionic polymers disclosed in U.S. Pat. Nos. 2,861,056 and 3,206,312; insoluble inorganic salts disclosed in U.S. Pat. No. 3,428,451; and stannic oxide fine particles disclosed in JP-A-60-252349 and JP-A-57-104931.

A method for obtaining a color image using the heat-developable recording material of the present invention is described in JP-A-7-13295, from line 43 on page 10 in the left column to line 40 on page 11 in the left column. Stabilizing agents for color dye image are described in British Patent No. 1,326,889, U.S. Pat. No. 3,432,300, No. 3,698,909, No. 3,574,627, No. 3,573,050, No. 3,764,337 and No. 4,042,394.

The heat-developable photographic emulsion in the heat-developable recording material of the present invention may be coated by a variety of coating processes, which include dip coating, air knife coating, flow coating, and extrusion coating using a specific hopper described in U.S. Pat. No. 2,681,294. It is also allowable to coat two or more layers as required according to the methods described in U.S. Pat. No. 2,761,791 and British Patent No. 837,095.

The heat-developable photosensitive material of the present invention may have additional layers such as dye accepting layer for accepting mobile dye image, opaque layer for effectuating reflective printing, protective top coat layer, and primer layer already known in the field of photothermal printing technology. It is preferable that the heat-developable recording material of the present invention is capable of producing image solely by itself. That is, it is preferable that the functional layer necessary for forming image, such as image accepting layer, is not provided on the separate photosensitive material.

The heat-developable recording material of the present invention may be developed by any method, while in general the development is performed by elevating the temperature of the heat-developable recording material after the image-wise exposure. Preferred embodiments of the heat-developing apparatus used include: those making the heat-developable recording material into contact with a heat source such as a heat roller or heat drum as disclosed in JP-B-5-56499, Japanese Patent No. 684453, JP-A-9-292695, JP-A-9-297385 and International Patent Publication WO95/30934; and those of non-contacting type as disclosed in JP-A-7-13294, International Patent Publications WO97/28489, WO97/28488 and WO97/28487. Of these, the non-contacting type heat-developing apparatus is preferred. The development temperature is preferably from 80 to 250° C., more preferably from 100 to 140° C. The development time is preferably from 1 to 180 seconds, more preferably from 10 to 90 seconds.

For preventing uneven processing due to dimensional changes in the heat-developable recording material of the present invention during heat development, it is preferable to heat the material at a temperature of 80° C. or above and less than 115° C. (preferably less than 113° C.) for 5 seconds or more so as to prevent the image from appearing, and then develop the material by heating at a temperature of 110° C. or above (and preferably less than 130° C.) to produce the image (so-called multi-stage heating method).

The heat-developable recording material of the present invention may be light-exposed by any method but the light source for the exposure is preferably a laser light. The laser light for use in the present invention is preferably one from a gas laser, YAG laser, dye laser, semiconductor laser or the like. The semiconductor laser as combined with a second harmonic generation device may also be used.

The heat-developable recording material of the present invention has a low haze at the exposure and is liable to incur generation of interference fringes. For preventing the generation of interference fringes, a technique of entering a laser light obliquely with respect to the recording material disclosed in JP-A-5-113548 and a method of using a multimode laser disclosed in International Patent Publication WO95/31754 are known and these techniques are preferably used.

The recording material of the present invention is preferably exposed such that the laser lights are overlapped and the scanning lines are not viewed as described in *SPIE,* Vol. 169, "Laser Printing", pages 116 to 128 (1979), JP-A-4-51043 and WO95/31754.

An exemplary structure of heat-developing apparatus used for the heat development of the heat-developable recording material of the present invention is shown in FIG. 1. FIG. 1 shows a side view of the heat-developing apparatus. The heat-developing apparatus shown in FIG. 1 comprises feed roller pairs 11 (the lower rollers are referred as to heat roller) for feeding into the heating section the heat-developable recording material 10 while leveling it to a planar state and preheating; and eject roller pairs 12 for ejecting from the heating section the heat-developable recording material 10 after the heat development while leveling it to a planar state. The heat-developable recording material 10 is developed during a period of its transference from the feed roller pairs 11 to eject roller pairs 12. To a transfer means for transferring the heat-developable recording material 10 during the heat development, a plurality of rollers 13 is provided on the side thereby to enable the rollers to contact with the plane on which the image-forming layer is provided, and a smooth plane 14 laminated with non-woven fabric (made of, for example, aromatic polyamide or Teflon) is provided on the opposite side where the back plane comes into contact. The heat-developable recording material 10 is transferred by the motion of a plurality of the rollers 13 contacting with the plane having the image-forming layer, while the back plane sliding on the smooth plane 14. As a heating means, heaters 15 are provided over the rollers 13 and behind the smooth plane 14 so as to heat the heat-developable recording material 10 from the both sides. An exemplary heating means relates to a panel heater. While a clearance between the rollers 13 and the smooth plane 14 may vary depending on the material of the smooth plane 14, it is properly adjusted, so as to allow the transference of the heat-developable recording material 10, preferably to 0 to 1 mm.

While any kind of material can be used for the surface of the roller 13 and smooth plane 14 as far as the material is durable against high temperatures and does not interfere the transference of the heat-developable recording material 10, preferable is silicone rubber for the surface of the roller 13, and non-woven fabric made of aromatic polyamide or Teflon (PTFE) for the smooth plane 14. As the heating means, a plurality of heaters are preferably used with their temperatures independently adjusted.

The heating section is composed of a preheating section having the feed roller pairs 11 and a heat developing section having the heaters 15; temperature of the preheating section provided upstream the heat developing section being preferably lower than the heat development temperature (by approx. 10 to 50° C., for example), and higher than the glass transition temperature (Tg) of the support of the heat-developable recording material 10 so as to prevent non-uniform development.

A slow cooling section having the eject roller pairs 12 and guide plate 16 is provided downstream the heat developing section. The guide plate 16 is preferably made of a material with a low heat conductivity and the cooling is preferably effected gradually.

While the heat-development apparatus is explained with reference to the drawing, it is not limited to the one shown in the drawing, and any one of heat-development apparatuses of various structures such as those disclosed in JP-A-7-13294, JP-A-10-177610 and JP-A-10-249940 can be used. When a multiple-step heat treatment successfully applicable to the present invention is employed, two or more of heat sources of different temperatures may be provided in such an apparatus mentioned above to afford continuous heating with different temperatures.

The present invention will be explained in more detail with reference to the following examples. However, materials, amount of use, ratios, operations and so forth described hereinafter are properly be altered without departing from the spirit of the present invention. The scope of the present invention, therefore, is not limited to specific embodiments described below.

EXAMPLES

Structural formulae of the compounds used in the embodiments are shown below:

Sensitizing dye-A

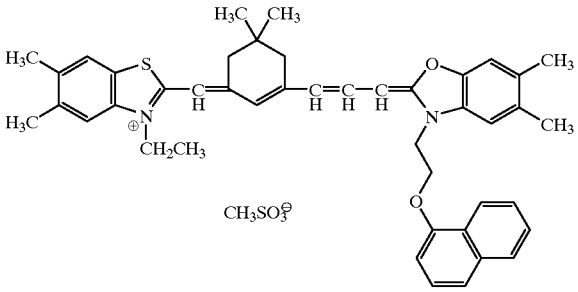

Compound-A

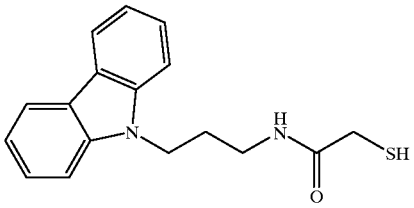

-continued

Compound-1

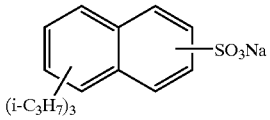

Compound-2

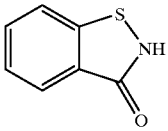

Compound-3

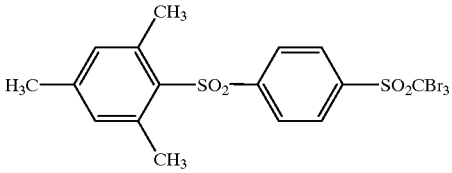

Compound-4

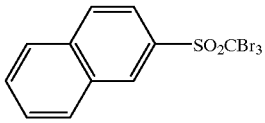

Compound-5

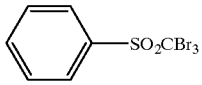

Compound-6

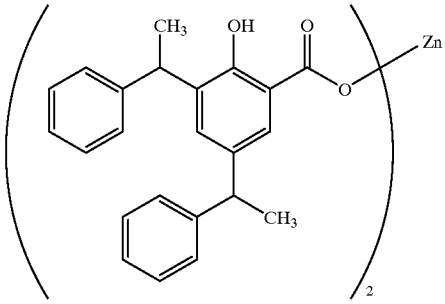

Compound-7

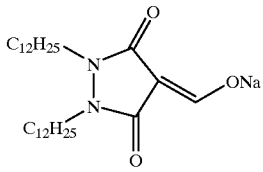

Compound-8

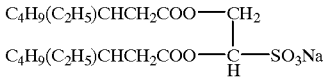

Compound-9

$C_8F_{17}SO_2N(C_3H_7)CH_2COOK$

Compound-10

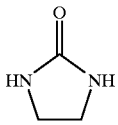

-continued

Dye A

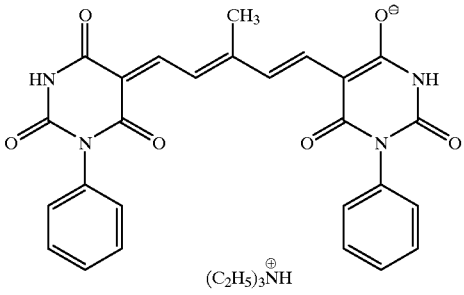

Example of Fabrication

Compositions used in the Example were prepared according to the following procedures:

<<Preparation of Silver Halide Emulsion A>>

To 700 ml of water, 11 g of phthalated gelatin, 30 mg of potassium bromide and 10 mg of sodium benzenethiosulfonate were added, and after conditioned to pH5.0 at 55° C., 159 ml of an aqueous solution containing 18.6 g of silver nitrate and an aqueous solution containing 1 mol/l of potassium bromide were added by the controlled double jet method over 6.5 minutes while keeping the pAg at 7.7. Subsequently, 476 ml of an aqueous solution containing 55.5 g of silver nitrate and an aqueous halogen salt solution containing 1 mol/l of potassium bromide were added by the controlled double jet method over 28.5 minutes while keeping the pAg at 7.7. Thereafter, the pH was lowered to cause coagulation precipitation to thereby effect desalting. Then 0.17 g of Compound-A and 23.7 g of deionized gelatin (as a calcium content of 20 ppm or lower) were added and conditioned to pH5.9 and pAg8.0. The obtained grain was found to be a cubic grain having an average grain size of 0.11 μm, a coefficient of variation of the projected area of 8% and a (100) plane ratio of 93%.

Thus obtained silver halide was heated to 60° C., added with sodium benzenethiosulfonate at a ratio of 76 μmol per 1 mol of silver, added with 154 μmol of sodium thiosulfonate 3 minutes after, and ripened for 100 minutes.

The mixture was then kept at 40° C., added with, per 1 mol of silver halide, $2.7\times10^{-3}$ mol of Sensitizing Dye-A and $8.2\times10^{-3}$ mol of Compound-A under stirring, and 20 minutes after rapidly cooled to 30° C. to complete the preparation of silver halide emulsion A.

<<Preparation of Organic Acid Silver Dispersion (Organic Acid Silver A)>>

A mixture of 6.1 g of arachidic acid, 37.6 g of behenic acid, 770 ml of distilled water, 70 ml of tert-butanol and 123 ml of an aqueous 1N NaOH solution was allowed to react at 75° C. for 1 hour under stirring, and then cooled to 65° C. The mixture was then added with 112.5 ml of an aqueous solution containing 22 g of silver nitrate over 45 seconds, allowed to stand for 5 minutes, and then cooled to 30° C. Thereafter, the solid content was separated by suction filtration, and washed with water until the conductivity of the filtrate became 30 μS/cm. Thus obtained solid content, handled as a wet cake without drying, was added with 2.0 g of polyvinyl alcohol (product name: PVA-217) for each volume of the wet cake equivalent to the dry weight of 100 g, and with water to adjust a total weight of 500 g, and was then preliminarily dispersed using a homomixer.

The predispersed source liquid was then dispersed further 3 times using a dispersion apparatus (product name: Microfluidizer M-110S-EH, product of Microfluidex International Corporation, using G10Z interaction chamber) under a pressure of 1750 kg/cm$^2$, to obtain a dispersion of organic acid silver dispersion. The organic acid silver grain contained in thus obtained organic acid silver dispersion was found to be an acicular grain having an average short axis length of 0.04 μm, an average long axis length of 0.8 μm and a coefficient of variation of 30%. The grain size was measured with MasterSizer X (product name, product of Malvern Instruments, Ltd.). In the cooling operation, coiled heat exchangers were attached to an inlet and outlet of the interaction chamber, respectively, and temperature of the coolant was controlled to attain a desired dispersion temperature. Organic acid silver A with a silver behenate content of 85 mol % was thus prepared.

<<Preparation of Solid Fine Particle Dispersion of 1,1-bis(2-hydroxy-3,5-dimethylphenyl)-3,5,5-trimethylhexane>>

To 70 g of 1,1-bis(2-hydroxy-3,5-dimethylphenyl)-3,5,5-trimethylhexane, added were 14 g of polyvinyl alcohol MP-203 (product name, product of Kuraray Co., Ltd.) and 266 ml of water, and then mixed thoroughly to prepare a slurry. The slurry was then put into a vessel of a dispersion apparatus (¼ G Sand Grinder Mill, product of Aimex, Ltd.) together with 960 g of zirconia silicate beads of 0.5 mm diameter, dispersed for 5 hours, and added with 100 ppm of Compound-2 per obtained volume to prepare a solid fine particle dispersion of the reducing agent. Eighty wt % of the particles was found to have a particle size of 0.3 to 1.0 μm. The solid fine particle dispersion of the reducing agent will be referred as EP dispersion hereinafter.

<<Preparation of Solid Fine Particle Dispersion of the Compound of the Present Invention >>

To 25 g of the above exemplified Compound A-9, added were 5.0 g of polyvinyl alcohol MP-203 (product name, product of Kuraray Co., Ltd.), 0.25 g of Compound-1and 70 g of water, to obtain a slurry. The slurry was then put into a vessel of a dispersion apparatus (1/16 G Sand Grinder Mill, product of Aimex, Ltd.) together with 200 g of zirconia silicate beads of 0.5 mm diameter, dispersed for 5 hours, added with 100 ppm of Compound-2 per obtained volume and stirred for 10 minutes to prepare a solid fine particle dispersion. An average particle size of thus obtained dispersion was found to be 0.35 μm, and a maximum particle size of 2.0 μm.

<<Preparation of Solid Fine Particle Dispersion of Polyhalide Compound>>

Thirty grams of Compound-3 was added with 5.0 g of polyvinyl alcohol MP-203 (product of Kuraray Co., Ltd.), 0.21 g of Compound-1 and 65 g of water, and the mixture was thoroughly stirred to prepare a slurry. The slurry was then put into a vessel of a dispersion apparatus (1/16 G Sand Grinder Mill, product of Aimex, Ltd.) together with 200 g of zirconia silicate beads of 0.5 mm diameter, dispersed for 5 hours, added thereafter with 20 ml of water and 100 ppm of Compound-2 per obtained volume and stirred for 10 minutes to prepare a solid fine particle dispersion. An average particle size of thus obtained dispersion was found to be 0.35 μm, and a maximum particle size 1.85 μm.

Compound-4 was also dispersed similarly as described above to prepare a solid fine particle dispersion.

<<Preparation of Solid Fine Particle Dispersion of Compound-6>>

To 7.5 g of above-described Compound-6, added were 3 g of polyvinyl alcohol MP-203 (product of Kuraray Co., Ltd.) and 90 ml of water, and the mixture was thoroughly stirred. Thereafter a solid fine particle dispersion was prepared similarly to the case with Compound-3.

<<Preparation of Solid Fine Particle Dispersion of Ultrahigh Contrast Agent>>

Ten grams of Compound-7 was added with 2.5 g of Poval PVA-217 (product of Kuraray Co., Ltd.) and 87.5 ml of water, and the mixture was thoroughly stirred to obtain a slurry. Thereafter a solid fine particle dispersion was prepared similarly to the case with Compound-3.

Example 1

<<Preparation of Coating Liquid for the Emulsion Layer>>

To the organic acid silver dispersion obtained above, the following binder, materials and silver halide emulsion A were added per 1 mol of silver in the dispersion, and water was further added to obtain a coating liquid for the emulsion layer.

Binder; LACSTAR 3307B 470 g as solid content (product of Dai-Nippon Ink & Chemicals, Inc., SBR latex, Tg=17° C.)

HP dispersion amounts shown in Table 1

Compounds of the general formula (1) amounts and types shown in Table 1

| | |
|---|---|
| Sodium benzenethiosulfonate | 0.5 g |
| 6-Methylbenzotriazole | 1.36 g |
| Polyvinyl alcohol (product of Kuraray Co., Ltd., PVA-235) | 12.1 g |
| Solid fine particle dispersion of Compound-3 | 33.6 gas Compound-3 |
| Solid fine particle dispersion of Compound-4 | 8.8 gas Compound-4 |
| Compound-5 (aqueous solution) | 1.1 g |
| Solid fine particle dispersion of Compound-6 | 10.5 gas Compound-6 |
| Sodium dihydrogen phosphate | 0.36 g |
| 6-iso-propylphthalazine | 16.5 g |
| Dye-A | 0.50 g |
| Sliver halide emulsion A | 0.05 mol as Ag |

<<Preparation of Coating Liquid for Emulsion Surface Protective Layer>>

To 109 g of polymer latex with a solid content of 27.5 wt % (methylmethacrylate/styrene/2-ethylhexylacrylate/2-hydroxyethyl methacrylate/metacrylic acid copolymer, copolymerization ratio=59/9/26/5/1, Tg=55° C.), added were 3.75 g of Compound-8, 0.125 g of Compound-9, 1.70 g of 4-methylphthalic acid, 0.59 g of Compound-10 and 0.285 g of polyvinyl alcohol (product of Kuraray Co., Ltd., PVA-235), and further added with water to a total weight of 150 g to obtain a coating liquid.

<<Manufacture of PET Support with Back/Undercoat Layers>>

(1) Support

PET with an intrinsic viscosity (IV) of 0.66(measured in phenol: tetrachloroethane=6:4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness of 120 μm after heat setting.

This film was longitudinally stretched 3.3 times using rollers different in the peripheral speed and then transversely stretched 4.5 times by a tenter at a temperature of 110° C. and 130° C., respectively. Subsequently, the film was heat-set at 240 ° C. for 20 seconds, and then relaxed by 4% in the transverse direction at the same temperature. Thereafter, the chuck part of the tenter was slit and the film was knurled at the both edges and then taken up at 4.8 kg/cm$^2$. Thus, a roll having a width of 2.4 m, a length of 3,500 m and a thickness of 120 μm was obtained.

(2) Undercoat layer (a)

| | |
|---|---|
| (2) Undercoat layer (a) | |
| Polymer latex (1) (styrene/butadiene/hydroxyethyl methacrylate/divinylbenzene = 67/30/2.5/0.5 (wt %)) | 160 mg/m$^2$ |
| 2,4-Dichloro-6-hydroxy-s-triazine | 4 mg/m$^2$ |
| Matting agent (polystyrene, average particle size: 2.4 μm) | 3 mg/m$^2$ |
| (3) Undercoat layer (b) | |
| Alkali-treated gelatin ($Ca^{2+}$ content: 30 ppm, jelly strength: 230 g) | 50 mg/m$^2$ |
| (4) Electroconductive layer | |
| JURIMER ET-410 (Nippon Jun'yaku) | 96 mg/m$^2$ |
| Gelatin | 50 mg/m$^2$ |
| Compound-A | 0.2 mg/m$^2$ |
| Polyoxyethylene phenyl ether | 10 mg/m$^2$ |
| SUMITEX RESIN M-3 (water-soluble melamine compound, Sumitomo Chemical) | 18 mg/m$^2$ |
| Dye-A | amount affording an optical density of 0.6 at 780 nm |
| $SnO_2$/Sb (9/1 by weight, acicular microparticles, long axis/short axis = 20 to 30, Ishihara Sangyo Kaisha Ltd.) | 120 mg/m$^2$ |
| Matting agent (polymethyl methacrylate, average particle size of 5 μm) | 7 mg/m$^2$ |
| (5) Protective layer | |
| Polymer Latex (2) (59/9/26/5/1 (wt %) copolymer of methyl methacrylate/styrene/2-ethylhexyl acrylate/2-hydroxyethyl methacrylate/methacrylic acid) | 1,000 mg/m$^2$ |
| Polystyrene sulfonate (molecular weight: 1,000 to 5,000) | 2.6 mg/m$^2$ |
| CELLOSOL 524 (produced by Chukyo Oil & Fat) | 30 mg/m$^2$ |
| SUMITEX RESIN M-3 (water-soluble melamine compound, produced by Sumitomo Chemical) | 218 mg/m$^2$ |

On one side of the support, the undercoat layer (a) and the undercoat layer (b) were sequentially coated and dried at 180° C. for 4 minutes, respectively. Subsequently, on the surface opposite to the surface having the coated undercoat layer (a) and undercoat layer (b), the electroconductive layer and the protective layer were sequentially coated and dried at 180° C. for 30 seconds, respectively, to manufacture a PET support with back/undercoat layers.

The PET support with back/undercoat layers obtained as described above was introduced into a heat treatment zone set at 150 ° C. and having a total length of 30 m, and transported by gravity at a tension of 14 g/cm$^2$ and a transportation speed of 20 m/min. Thereafter, the support was passed through a zone at 40° C. for 15 seconds, and taken up at a take-up tension of 10 kg/cm$^2$.

<<Manufacture of Heat-Developable Photosensitive Material>>

On the undercoat layers on the PET support with back/undercoat layers, the coating liquid for the emulsion layer was coated so as to attain a coated amount of silver of 1.8 g/m$^2$. Other coating liquids with different amounts of addition of the HP compounds were also prepared and coated on the support in a similar manner. Coated amounts of the HP compounds were shown in Table 1. Further thereon, the coating liquid for the emulsion surface protective layer was coated so as to attain a coated amount as solid content of polymer latex of 2.0 g/m$^2$.

<<Evaluation of Photographic Performance>>

The obtained samples were exposed with a xenon flash light having an emission time of $10^{-6}$ seconds through an interference filter having a peak at 780 nm and a step wedge.

The light-exposed samples were heat-developed at 117° C. for 20 seconds, at 119° C. for 20 seconds or at 121° C. for 20 seconds in such a heat-developing apparatus as shown in FIG. 1. In the drum-type heat developing apparatus of FIG. 1, the direction of the lamp was optimized, so that temperature control precision of ±1° C. along the transverse direction could be obtained. The atmospheric temperature was controlled so that the temperature of the heat-developable recording material in the vicinity of the guide panel 16 does not decreased to 90° C. or lower.

The images obtained were evaluated using a densitometer. The measurement results were evaluated for Dmax, fog (Dmin) and sensitivity (a relative reciprocal value of the ratio of the exposure amount necessary for giving a density higher than Dmin by 1.5). The sensitivity (S1.5) was expressed assuming a sensitivity for Sample No. 101 as "100". Difference of the sensitivity (ΔS1.5) was expressed as differences between S1.5 s (differences of logarithmic values of exposure amounts) obtained from the developments at 117° C. and 121° C., respectively.

<<Results>>

It was found from the results in Table 1 that Sample Nos. 103 and 104 showed higher sensitivities as compared with Sample Nos. 101 and 102, but showed significant increases in fog and were still at high levels of differences of sensitivity. Sample Nos. 105 to 117 on the other hand showed quite small increases in fog, high sensitivities and small differences of sensitivity under altered development temperature.

Example 2

Coating liquid for the emulsion layer was prepared similarly to Example 1, except that, at the time of the preparation thereof, 1.1 g of solid fine particle dispersion of Compound-7 as an ultrahigh contrast agent per 1 mol of silver in the organic acid silver dispersion was added, and the dispersion of the exemplary compounds of formula (1) and the HO dispersion were also added at amounts listed in Table 2. The coating liquid was then similarly coated, and the recording material was subjected to the property evaluation. Besides the items for the evaluation in Example 1, gradation (contrast) was also included thereto. The contrast (γ) was expressed by a gradient of a straight line connecting the points at the densities of 0.3 and 3.0. Results were shown in Table 2.

TABLE 1

| Sample | HP dispersion | General Formula (1) | | Photographic properties (119° C., 20 sec.) | | | | |
|---|---|---|---|---|---|---|---|---|
| No. | Mol/mol Ag | Type | mol/mol Ag | Dmin | S1.5 | Dmax | ΔS1.5 | Remarks |
| 101 | $3.2 \times 10^{-1}$ | — | — | 0.12 | 100 | 3.5 | 0.25 | Comparison |
| 102 | $4.8 \times 10^{-1}$ | — | — | 0.15 | 145 | 3.7 | 0.28 | Comparison |
| 103 | — | A-9 | $3.2 \times 10^{-1}$ | 0.42 | 213 | 3.6 | 0.24 | Comparison |
| 104 | — | A-73 | $3.2 \times 10^{-1}$ | 0.46 | 184 | 3.5 | 0.26 | Comparison |
| 105 | $3.2 \times 10^{-1}$ | A-3 | $5.0 \times 10^{-2}$ | 0.14 | 191 | 3.8 | 0.13 | Invention |
| 106 | $3.2 \times 10^{-1}$ | A-9 | $3.0 \times 10^{-3}$ | 0.12 | 157 | 3.6 | 0.18 | Invention |
| 107 | $3.2 \times 10^{-1}$ | A-9 | $6.0 \times 10^{-3}$ | 0.12 | 191 | 3.8 | 0.16 | Invention |
| 108 | $3.2 \times 10^{-1}$ | A-9 | $1.2 \times 10^{-2}$ | 0.13 | 200 | 3.8 | 0.15 | Invention |
| 109 | $3.2 \times 10^{-1}$ | A-9 | $2.5 \times 10^{-2}$ | 0.13 | 208 | 3.8 | 0.15 | Invention |
| 110 | $3.2 \times 10^{-1}$ | A-31 | $1.2 \times 10^{-2}$ | 0.12 | 188 | 3.7 | 0.13 | Invention |
| 111 | $3.2 \times 10^{-1}$ | A-73 | $2.5 \times 10^{-2}$ | 0.15 | 191 | 3.4 | 0.15 | Invention |
| 112 | $3.2 \times 10^{-1}$ | A-74 | $5.0 \times 10^{-1}$ | 0.12 | 186 | 3.8 | 0.13 | Invention |
| 113 | $3.2 \times 10^{-1}$ | A-74 | $1.0 \times 10^{-1}$ | 0.12 | 229 | 3.8 | 0.13 | Invention |
| 114 | $3.2 \times 10^{-1}$ | A-74 | $2.0 \times 10^{-1}$ | 0.13 | 251 | 3.6 | 0.13 | Invention |
| 115 | $3.2 \times 10^{-1}$ | A-89 | $1.2 \times 10^{-2}$ | 0.11 | 201 | 3.8 | 0.14 | Invention |
| 116 | $3.2 \times 10^{-1}$ | A-89 | $2.0 \times 10^{-2}$ | 0.12 | 205 | 3.9 | 0.14 | Invenion |
| 117 | $3.2 \times 10^{-1}$ | A-89 | $4.0 \times 10^{-2}$ | 0.12 | 209 | 3.9 | 0.14 | Invention |

TABLE 2

| Sample | HP dispersion | General Formula (1) | | Photographic properties (119° C., 20 sec.) | | | | | |
|---|---|---|---|---|---|---|---|---|---|
| No. | Mol/mol Ag | Type | mol/mol Ag | Dmin | S1.5 | γ | Dmax | ΔS1.5 | Remarks |
| 201 | $2.8 \times 10^{-1}$ | — | — | 0.12 | 100 | 18 | 4.5 | 0.33 | Comparison |
| 202 | $4.2 \times 10^{-1}$ | — | — | 0.15 | 158 | 20 | 4.8 | 0.30 | Comparison |
| 203 | — | A-10 | $5.0 \times 10^{-2}$ | 0.12 | 25 | — | 0.75 | — | Comparison |
| 204 | — | A-10 | $2.8 \times 10^{-1}$ | 0.58 | 209 | 14 | 4.0 | 0.25 | Comparison |
| 205 | — | A-77 | $2.8 \times 10^{-1}$ | 0.53 | 216 | 15 | 4.2 | 0.21 | Comparison |
| 206 | $2.8 \times 10^{-1}$ | A-10 | $3.0 \times 10^{-1}$ | 0.12 | 177 | 20 | 4.6 | 0.19 | Invention |
| 207 | $2.8 \times 10^{-1}$ | A-10 | $6.0 \times 10^{-3}$ | 0.12 | 191 | 23 | 4.7 | 0.17 | Invention |
| 208 | $2.8 \times 10^{-1}$ | A-10 | $1.2 \times 10^{-2}$ | 0.12 | 216 | 26 | 4.8 | 0.15 | Invention |
| 209 | $2.8 \times 10^{-1}$ | A-10 | $2.5 \times 10^{-2}$ | 0.12 | 251 | 25 | 4.8 | 0.17 | Invention |
| 210 | $2.8 \times 10^{-1}$ | A-10 | $5.0 \times 10^{-2}$ | 0.13 | 263 | 25 | 4.8 | 0.17 | Invention |

TABLE 2-continued

| Sample No. | HP dispersion Mol/mol Ag | General Formula (1) Type | mol/mol Ag | Photographic properties (119° C., 20 sec.) Dmin | S1.5 | γ | Dmax | ΔS1.5 | Remarks |
|---|---|---|---|---|---|---|---|---|---|
| 211 | $2.8 \times 10^{-1}$ | A-12 | $1.2 \times 10^{-2}$ | 0.12 | 204 | 24 | 4.7 | 0.15 | Invention |
| 212 | $2.8 \times 10^{-1}$ | A-31 | $2.5 \times 10^{-2}$ | 0.12 | 251 | 23 | 4.8 | 0.17 | Invention |
| 213 | $2.8 \times 10^{-1}$ | A-32 | $5.0 \times 10^{-2}$ | 0.12 | 207 | 25 | 4.8 | 0.15 | Invention |
| 214 | $2.8 \times 10^{-1}$ | A-70 | $5.0 \times 10^{-2}$ | 0.14 | 186 | 25 | 4.8 | 0.15 | Invention |
| 215 | $2.8 \times 10^{-1}$ | A-74 | $2.5 \times 10^{-2}$ | 0.12 | 214 | 24 | 4.8 | 0.18 | Invention |
| 216 | $2.8 \times 10^{-1}$ | A-74 | $1.0 \times 10^{-1}$ | 0.12 | 263 | 24 | 4.6 | 0.18 | Invention |
| 217 | $2.8 \times 10^{-1}$ | A-74 | $1.5 \times 10^{-1}$ | 0.14 | 285 | 22 | 4.5 | 0.16 | Invention |
| 218 | $2.8 \times 10^{-1}$ | A-77 | $5.0 \times 10^{-2}$ | 0.15 | 191 | 22 | 4.8 | 0.19 | Invention |
| 219 | $2.8 \times 10^{-1}$ | A-84 | $5.0 \times 10^{-2}$ | 0.12 | 214 | 21 | 4.7 | 0.18 | Invention |
| 220 | $2.8 \times 10^{-1}$ | A-89 | $1.2 \times 10^{-2}$ | 0.12 | 204 | 25 | 4.8 | 0.17 | Invention |
| 221 | $2.8 \times 10^{-1}$ | A-89 | $2.0 \times 10^{-2}$ | 0.12 | 210 | 25 | 4.9 | 0.18 | Invention |
| 222 | $2.8 \times 10^{-1}$ | A-89 | $4.0 \times 10^{-2}$ | 0.12 | 219 | 26 | 4.9 | 0.18 | Invention |

It was found from the results in Table 2 that Sample No. 203 failed in achieving a sufficient sensitivity and Dmax as compared with those for Sample Nos. 201 and 202. Sample Nos. 204 and 205 showed significant increases in fog while sensitivity improved. Sample Nos. 206 to 222 on the other hand showed quite small increases in fog, high sensitivities and small differences of sensitivity under altered development temperature.

What is claimed is:

1. A heat-developable recording material having, at least on one side of the support, (a) reducible silver salt, (b) a hindered phenol, (c) a binder, (d) at least one compound represented by the formula (1) below, and (e) an ultrahigh contrast agent;

wherein content of the compound represented by the formula (1) begin 1 to 20 mol % based on the reducing agent:

formula (1)

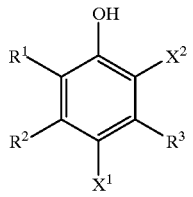

in formula (1), $R^1$, $R^2$, $R^3$, $X^1$ and $X^2$ independently represent a hydrogen atom; halogen atom; or substituent which is bound to the benzene ring via a carbon atom, oxygen atom, nitrogen atom, sulfur atom or phosphorous atom, at least either $X^1$ or $X^2$ represents a group represented as $-NR^4R^5$, where $R^4$ and $R^5$ independently represent a group selected from a hydrogen atom, alkyl group, alkenyl group, alkynyl group, aryl group, or a group represented by —C—(=O)—R, —C—(=O)—C (R represents a group selected from a hydrogen atom, alkyl group, aryl group, heterocyclic group, amino group, alkoxy group and aryloxy group; adjacent groups of the above substituents may bind each other to form a ring;

wherein the ultrahigh contrast agent is at least one compound selected from the group consisting of the compounds respectively represented by the formulae (2), (3) and (4), below:

formula (2)

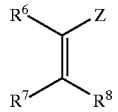

formula (3)

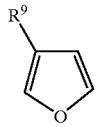

formula (4)

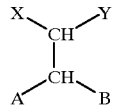

in formula (2), $R^6$, $R^7$ and $R^8$ independently represent a hydrogen atom or substituent, and Z represents an electron withdrawing group or silyl group, wherein in formula (2), $R^6$ and Z; $R^7$ and $R^8$; $R^6$ and $R^7$; or $R^8$ and Z may bind with each other to form a ring structure, wherein in formula (3), $R^9$ represents a substituent, wherein in formula (4), X and Y independently represent a hydrogen atom or substituent; and A and B independently represent an alkoxy group, alkylthio group, alkylamino group, aryloxy group, arylthio group, anilino group, heterocyclic oxy group, heterocyclic thio group or heterocyclic amino group, and wherein in formula (4), X and Y; or A and B may bind with each other to form a ring structure.

2. The heat-developable recording material of claim 1, wherein a photosensitive silver halide is contained to provide a heat-developable photosensitive recording material.

3. The heat-developable recording material of claim 1, wherein, in the formula (1), $R^1$, $R^2$ and $R^3$ independently represent a hydrogen atom, halogen atom, methyl group, to-butyl group, cyclohexyl group, phenyl group, 3,5-dichlorophenyl, acetyl group, benzoyl group, ethoxycarbonyl group, phenoxycarbonyl group, cyano group, carboxyl group, acetoxy group, acetylamino group, methoxycarbonylamino group, phenoxycarbonylamino group, methansulfonylamino group, carbamoyl group, sulfo group, trifluoromethylsulfonyl group or benzenesulfonyl group.

4. The heat-developable recording material of claim 1, wherein, in the formula (1), one of $X^1$ and $X^2$ independently represent a hydrogen atom, halogen atom, normal, branched or cyclic alkyl group, aryl group, acyl group, alkoxycarbonyl group, aryloxycarbonyl group, cyano group, carboxyl group, alkoxy group, aryloxy group, acyloxy group, carbamoyl group, mercapto group or alkylthio group.

5. The heat-developable recording material of claim 1, wherein, in the formula (1), $R^4$ and $R^5$ independently represent a hydrogen atom, normal, branched or cyclic alkyl group, aryl group, acyl group or sulfonyl group.

6. The heat-developable recording material of claim 1, wherein, in the formula (1), either $R^4$ or $R^5$ represents a hydrogen atom and the other represents an alkylsulfonyl group or arylsulfonyl group.

7. The heat-developable recording material of claim 1, wherein, the compound represented by the formula (1) is contained in the image-forming layer or the layer adjacent thereto.

* * * * *